US006237739B1

(12) United States Patent
Mazur et al.

(10) Patent No.: US 6,237,739 B1
(45) **Date of Patent: *May 29, 2001**

(54) INTELLIGENT DOCUMENT HANDLING SYSTEM

(75) Inventors: Richard A. Mazur, Naperville; Frank M. Csulits, Gurnee; Douglas U. Mennie, Barrington, all of IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/232,093

(22) Filed: Jan. 15, 1999

Related U.S. Application Data

(63) Continuation-in-part of application No. 08/852,400, filed on May 7, 1997, now Pat. No. 6,012,565
(60) Provisional application No. 60/075,991, filed on Feb. 25, 1998.

(51) Int. Cl.[7] ..... G07D 7/12
(52) U.S. Cl. ..... 194/207; 382/135
(58) Field of Search ..... 194/206, 207; 377/8; 209/534; 382/135

(56) References Cited

U.S. PATENT DOCUMENTS

| | | | |
|---|---|---|---|
| Re. 31,692 | 10/1984 | Tyburski et al. . | |
| D. 369,984 | 5/1996 | Larsen | D10/97 |
| 3,245,534 | 4/1966 | Smith et al. . | |

(List continued on next page.)

FOREIGN PATENT DOCUMENTS

| | | |
|---|---|---|
| 4310216 | 9/1994 | (DE) . |
| 0077464 | 4/1983 | (EP) . |
| 101115 | 2/1984 | (EP) . |

(List continued on next page.)

OTHER PUBLICATIONS

"Sale of Doubles Detection 7/91".
"Sale of Magnetic Detection 7/91".
"Sale of Doubles Detection 6/92".

(List continued on next page.)

*Primary Examiner*—F. J. Bartuska
(74) *Attorney, Agent, or Firm*—Jenkens & Gilchrist

(57) ABSTRACT

A document handling system is adapted to evaluate documents such as currencies of any denomination or type without having been pre-programmed with data representative of the denominations or types. The currency handling system is capable of generating such data internally, by scanning sets of master currency bills to obtain master information representative of the master bills which may be used to evaluate subsequent test bills. The master currency bills may comprise bills of different currency types, including bills issued by different countries. The master information may comprise numerical and/or non-numerical data. The evaluation of the test bills is based on a comparison of either pre-stored or self-generated master information with scanned data values associated with the test bills. Master information derived by one machine may be quickly and efficiently loaded into one or more other machines through a flash card loading system, thereby permitting the other machine(s) to evaluate authenticate test bills using master information obtained by the first machine. In one embodiment, the master information and characteristic data are normalized before denomination or authentication is performed to account for variations in individual machines.

115 Claims, 16 Drawing Sheets

U.S. PATENT DOCUMENTS

| | | | | |
|---|---|---|---|---|
| 3,246,295 | | 4/1966 | DeClaris et al. | 382/56 |
| 3,280,974 | | 10/1966 | Riddle et al. | 209/111.8 |
| 3,480,785 | | 11/1969 | Aufderheide | 250/219 |
| 3,496,370 | | 2/1970 | Haville et al. | 250/219 |
| 3,509,535 | | 4/1970 | Berube | 340/149 |
| 3,612,835 | | 10/1971 | Andrews et al. | 235/61.11 D |
| 3,618,765 | | 11/1971 | Cooper et al. | 209/534 |
| 3,679,314 | | 7/1972 | Mustert | 356/71 |
| 3,778,628 | | 12/1973 | Novak et al. | 250/556 |
| 3,842,281 | | 10/1974 | Goodrich | 250/461 |
| 3,870,629 | | 3/1975 | Carter et al. | 209/111.8 |
| 3,906,449 | | 9/1975 | Marchak | 340/149 R |
| 3,976,198 | | 8/1976 | Carnes, Jr. et al. | 209/111.7 T |
| 4,041,456 | | 8/1977 | Ott et al. | 340/146.3 R |
| 4,081,131 | | 3/1978 | Sand et al. | 364/550 |
| 4,096,991 | | 6/1978 | Iquchi | 235/419 |
| 4,114,804 | | 9/1978 | Jones et al. | 235/476 |
| 4,147,430 | | 4/1979 | Gorgone et al. | 356/51 |
| 4,179,685 | | 12/1979 | O'Maley | 340/146.3 |
| 4,255,651 | | 3/1981 | Phillips | 235/92 |
| 4,277,774 | | 7/1981 | Fuji et al. | 340/146.3 |
| 4,283,708 | | 8/1981 | Lee | 340/146.32 |
| 4,288,781 | | 9/1981 | Sellner et al. | 340/146.3 |
| 4,302,781 | | 11/1981 | Ikeda et al. | 358/486 |
| 4,311,914 | | 1/1982 | Huber | 250/556 |
| 4,313,598 | | 2/1982 | DiBlasio | 271/124 |
| 4,334,619 | | 6/1982 | Horino et al. | 209/551 |
| 4,348,656 | | 9/1982 | Gorgone et al. | 340/146.3 R |
| 4,349,111 | | 9/1982 | Shah et al. | 209/534 |
| 4,355,300 | | 10/1982 | Weber | 340/146.3 C |
| 4,356,473 | | 10/1982 | Freudenthal | 340/146.3 H |
| 4,381,447 | | 4/1983 | Horvath et al. | 250/223 |
| 4,386,432 | | 5/1983 | Nakamura et al. . | |
| 4,442,541 | | 4/1984 | Finkel et al. . | |
| 4,461,028 | | 7/1984 | Okubo | 382/15 |
| 4,464,786 | | 8/1984 | Nishito et al. . | |
| 4,464,787 | | 8/1984 | Fish et al. . | |
| 4,470,496 | | 9/1984 | Steiner | 209/534 |
| 4,480,177 | | 10/1984 | Allen | 235/379 |
| 4,482,058 | | 11/1984 | Steiner | 209/534 |
| 4,490,846 | | 12/1984 | Ishida et al. . | |
| 4,503,963 | | 3/1985 | Steiner . | |
| 4,513,439 | | 4/1985 | Gorgone et al. . | |
| 4,539,702 | | 9/1985 | Oka . | |
| 4,556,140 | | 12/1985 | Oakada . | |
| 4,558,224 | | 12/1985 | Gober | 250/460.1 |
| 4,563,771 | | 1/1986 | Gorgone et al. . | |
| 4,567,370 | | 1/1986 | Falls | 250/461.1 |
| 4,587,412 | | 5/1986 | Apidorf | 235/449 |
| 4,587,434 | | 5/1986 | Roes et al. | 250/556 |
| 4,592,090 | | 5/1986 | Curl et al. . | |
| 4,628,194 | | 12/1986 | Dobbins et al. | 235/379 |
| 4,645,936 | | 2/1987 | Gorgone | 250/556 |
| 4,653,647 | | 3/1987 | Hashimoto | 209/534 |
| 4,677,682 | | 6/1987 | Miyagawa et al. . | |
| 4,700,368 | | 10/1987 | Munn et al. | 377/8 |
| 4,733,308 | | 3/1988 | Nakamura et al. | 358/496 |
| 4,749,087 | | 6/1988 | Buttifant . | |
| 4,789,345 | | 12/1988 | Carter | 439/71 |
| 4,817,176 | | 3/1989 | Marshall et al. | 382/43 |
| 4,823,393 | | 4/1989 | Kawakami . | |
| 4,830,742 | * | 5/1989 | Takesako | 209/534 |
| 4,837,426 | | 6/1989 | Pease et al. | 235/440 |
| 4,881,268 | | 11/1989 | Uchida et al. . | |
| 4,906,988 | | 3/1990 | Copella | 340/825.34 |
| 4,908,516 | | 3/1990 | West | 250/556 |
| 4,953,086 | | 8/1990 | Fukatsu | 364/408 |
| 4,985,614 | | 1/1991 | Pease et al. | 235/440 |
| 4,992,860 | | 2/1991 | Hamaquchi et al. | 358/75 |
| 4,996,604 | | 2/1991 | Ogawa et al. | 358/486 |
| 5,027,415 | | 6/1991 | Hara et al. | 382/135 |
| 5,047,871 | | 9/1991 | Meyer et al. | 358/486 |
| 5,066,992 | | 11/1991 | Wu et al. | 357/23.5 |
| 5,068,519 | | 11/1991 | Bryce | 235/449 |
| 5,122,754 | | 6/1992 | Gotaas | 324/676 |
| 5,163,672 | | 11/1992 | Mennie | 271/187 |
| 5,167,313 | | 12/1992 | Dobbins et al. | 194/317 |
| 5,201,395 | | 4/1993 | Takizawa et al. | 194/206 |
| 5,207,788 | | 5/1993 | Geib et al. | 271/122 |
| 5,236,072 | | 8/1993 | Cargill | 194/207 |
| 5,256,080 | | 10/1993 | Bright | 439/342 |
| 5,261,518 | | 11/1993 | Bryce | 194/206 |
| 5,304,813 | | 4/1994 | DeMan | 250/556 |
| 5,341,408 | | 8/1994 | Melcher et al. | 377/8 |
| 5,342,213 | | 8/1994 | Kobayaski | 439/268 |
| 5,367,577 | | 11/1994 | Gotaas | 382/135 |
| 5,430,664 | | 7/1995 | Cargill et al. | 364/550 |
| 5,454,727 | | 10/1995 | Hsu | 439/263 |
| 5,457,336 | | 10/1995 | Fang et al. | 257/322 |
| 5,462,149 | * | 10/1995 | Waine et al. | 194/206 |
| 5,465,821 | | 11/1995 | Akioka | 194/207 |
| 5,467,405 | | 11/1995 | Raterman et al. | 382/135 |
| 5,467,406 | | 11/1995 | Graves et al. | 382/135 |
| 5,493,534 | | 2/1996 | Mok | 365/226 |
| 5,505,834 | | 4/1996 | Chaug et al. | 340/825 |
| 5,542,468 | | 8/1996 | Lin | 165/80.3 |
| 5,633,949 | | 5/1997 | Graves et al. | 382/135 |
| 5,652,802 | | 7/1997 | Graves et al. | 382/135 |
| 5,671,410 | * | 9/1997 | Mizuno et al. | 395/615 |
| 5,687,963 | | 11/1997 | Mennie | 271/119 |
| 5,692,067 | | 11/1997 | Raterman et al. | 382/135 |
| 5,704,491 | | 1/1998 | Graves | 209/534 |
| 5,724,438 | | 3/1998 | Graves | 382/135 |
| 5,751,840 | | 5/1998 | Raterman et al. | 382/135 |
| 5,790,693 | | 8/1998 | Graves et al. | 382/135 |
| 5,790,697 | | 8/1998 | Munro et al. | 382/135 |
| 5,806,650 | | 9/1998 | Mennie et al. | 194/206 |
| 5,815,592 | | 9/1998 | Mennie et al. | 382/135 |
| 5,822,448 | | 10/1998 | Graves et al. | 382/135 |
| 5,832,104 | | 11/1998 | Graves et al. | 382/135 |
| 5,867,589 | | 2/1999 | Graves et al. | 382/135 |
| 5,870,487 | | 2/1999 | Graves et al. | 382/135 |
| 5,875,259 | | 2/1999 | Mennie et al. | 382/135 |

FOREIGN PATENT DOCUMENTS

| | | |
|---|---|---|
| 0 342 647 A2 | 5/1989 | (EP) . |
| 0338123 | 10/1989 | (EP) . |
| 0342647 | 11/1989 | (EP) . |
| 690451 | 1/1996 | (EP) . |
| 0700098 | 3/1996 | (EP) . |
| 0718809 A2 | 6/1996 | (EP) . |
| 2190996A | 12/1987 | (GB) . |
| 54-71673 | 6/1979 | (JP) . |
| 54-71674 | 6/1979 | (JP) . |
| 56-136689 | 10/1981 | (JP) . |
| 61-14557 | 4/1986 | (JP) . |
| 61-41439 | 9/1986 | (JP) . |
| WO 90/07165 | 6/1990 | (WO) . |
| WO 91/11778 | 8/1991 | (WO) . |
| WO 93/23824 | 11/1993 | (WO) . |
| WO 94/19773 | 9/1994 | (WO) . |
| WO 95/24691 | 9/1995 | (WO) . |
| WO 96/10800 | 4/1996 | (WO) . |

OTHER PUBLICATIONS

"Sale of Multiple Density Sensitivity Setting 4/93".

"Offer for Sale of Optical/Magnetic Detection 9/92".

Mosler CF–420 Cash Management System Operator's Manual, cover, copyright page, and chapter 5 pp. 5–1 through 5–16, copyrighted 1989.

JetScan Currency Scanner/Counter, Model 4060, Operator's Manual by Cummins–Allison (8/91).
Sale of JetScan Currency Scanner/Counter, Model 4060 (8/91).
JetScan Currency Scanner/Counter, Model 4061, Operating Instructions by Cummins–Allison (Apr. 20, 1993).
Sale of JetScan Currency Scanner/Counter, Model 4061 (Apr. 20, 1993).
JetScan Currency Scanner/Counter, Model 4062, Operating Instructions by Cummins–Allison (Nov. 28, 1994).
Sale of JetScan Currency Scanner/Counter, Model 4062 (Nov. 28, 1994).
AFB Currency Recognition System (1982).
Mosler Inc. brochure "The Mosler/Toshiba CF–420," 1989.
"Flash Memory Products—1996 Data Book/Handbook," Advanced Micro Devices, Sunnyvale, CA.
"FlashLite™ Memory Cards" Catalog 296045, AMP Inc., Harrisburg PA, Jul. 1995.
"AMP PC Card Conectors" Catalog 65701, AMP Inc., Harrisburg PA, Sep. 1995.
Translation of EP 0 342 647 A2.
First Translation of JP 61–14557.
Second Translation of 61–14557 (Glory).
Translation of JP 54–71673.
Translation of JP 54–71674.
Translation of JP 61–41439.
First Translation of JP 56–136689.
Second Translation of JP 56–136689 (Glory).
Billcon D–202/204 Service Manual (cover marked 630229) (Japanese).
Translation of Billcon D–202/204 Service Manual—(H13).
Billicon D–202, D204 Operator's Manual (cover marked 611215) (Japanese).
First Translation of Billcon D–202, D204 Operator'Manual (H15).
Second Translation of Billcon D–202, D204 Operator's Manual (H15) (Glory).
Banking Machine Digest No. 31 (last page of H19 translation has a date of Dec. 5, 1988) (Japanese).
First Translation of Banking Machine Digest No. 31 (H18).
Second Translation of Banking Machine Digest No. 31 (H18) (Glory).
Third Translation of Banking Machine Digest No. 31 (H18).

* cited by examiner

FIG. 12 TIMING DIAGRAM

INTELLIGENT DOCUMENT HANDLING SYSTEM

CROSS-REFERENCE TO RELATED APPLICATIONS

This application is a continuation-in-part of pending U.S. Pat. application Ser. No. 08/852,400, filed May 7, 1997 now U.S. Pat. No. 6,012,565 and entitled "Intelligent Currency Handling System" and claims the benefit of Provisional patent application Ser. No. 60/075,991, filed Feb. 25, 1998 and entitled "Intelligent Document Handling System." The parent application has the same assignee as the present invention and is incorporated herein by reference in its entirety.

FIELD OF THE INVENTION

The present invention relates generally to the field of document handling systems and, more particularly, to a document handling system having the capability to learn to accommodate new types of documents, such as currency bills, analyze selected attributes of the documents and independently generate master information associated with the selected attributes which may be used in evaluating subsequent documents.

BACKGROUND OF THE INVENTION

A variety of techniques and apparatus have been used to satisfy the requirements of automated currency handling machines. At the upper end of sophistication in this area of technology are machines which are capable of rapidly identifying, discriminating and counting multiple currency denominations. This type of machine, hereinafter designated as a "denomination discriminator," typically employs, for example, either magnetic sensing or optical sensing for identifying the denominations of bills in a stack and discriminating between different currency denominations. Denomination discriminators employ tests that have a high degree of accuracy in determining the denomination of a bill. For example, by comparing an optical pattern retrieved by scanning a test bill with stored master optical patterns associated with bills of different denomination, the denomination of the bill can be called with a great degree of accuracy where the scanned pattern generated by scanning the test bill sufficiently matches one of the stored master patterns.

At a lower level of sophistication in this area are machines which are designed to rapidly count the number of currency bills in a stack, but which are not designed to identify or discriminate among multiple currency denominations. This type of machine, hereinafter designated as a "note counter" or simply "counter," may include sensors such as magnetic or optical sensors sufficient to enable it to discriminate between acceptable and non-acceptable bills (including counterfeit bills) in a stack of bills having a known denomination, but do not permit the machine to identify the denomination of bills or discriminate among multiple denominations of currency. Consequently, counters do not generally "know" what denomination they are counting until they are informed of the particular denomination by an external signal or by an operator input.

Whether employed in a denomination discriminator or counter, magnetic sensing is based on detecting the presence or absence of magnetic ink in portions of the printed indicia on the currency by using magnetic sensors, usually ferrite core-based sensors, and using the detected magnetic signals, after undergoing analog or digital processing, as the basis for discrimination. The more commonly used optical sensing technique, on the other hand, is based on detecting and analyzing variations in light reflectance or transmissivity characteristics occurring when a currency bill is illuminated and scanned by a strip of focused light. The subsequent currency discrimination is based on the comparison of sensed optical or magnetic characteristics with prestored parameters relating to different currency denominations, while accounting for adequate tolerances reflecting differences among bills of a given denomination. Similarly, the acceptance or rejection of a bill is based on the comparison of sensed optical or magnetic characteristics with prestored parameters defining an acceptable bill, while accounting for adequate tolerances reflecting differences among bills of a given denomination.

Document handling machines (e.g., denomination discriminators or counters) known in the art typically include a system memory for storing sets of stored master information associated with characteristics of the various currency denominations to be evaluated or counted. The types of master information stored in the system memory generally depend upon the denominations and types of currency which a machine is designed to accommodate. For example, it has been found that master information obtained from an optical scanning technique may be used to discriminate between different denominations of U.S. currency. An example of a document handling machine using an optical scanning technique is described in U.S. Pat. No. 5,295,196, issued Mar. 15, 1994 to Raterman et al. and assigned to Cummins-Allison Corporation, incorporated herein by reference. Document handling machines designed to accommodate currencies of other countries may utilize different sets of stored master information to correspond to different characteristics of the foreign bills. For example, while all denominations of U.S. currency are the same size, in many other countries currencies vary in size by denomination. Furthermore, there is a wide variety of bill sizes among different countries. In addition to size, the color of currency can vary by country and by denomination. Likewise, many other characteristics may vary between bills of different countries and of different denominations.

The types or denominations of currency which a machine is able to accommodate is dependent on the content of the master information which it includes in system memory. For example, a machine designed for U.S. markets may be programmed with master information associated with magnetic and/or optical characteristics of U.S. currency, while a machine designed for a foreign market may be programmed with master information associated with the size and/or color of the foreign currency. A machine designed to handle bills of one country generally cannot handle bills from another country unless it has been provided with master information appropriate for both countries. Once programmed with the appropriate master information, the system memory may require periodic updates or supplements in order to reflect the most recent optical or magnetic characteristics of the various currency denominations to be evaluated, which may occur, for example, upon the issuance of a new series of bills.

Heretofore, the encoding or updating of master information into the system memory of currency evaluation machines (e.g., discrimination machines or counters) has been accomplished externally from the machine, typically at a factory or service center. For example, in currency evaluation machines employing memory chips such as erasable programmable read only memories (EPROMs), the chips are typically programmed or updated at the factory or service center and either installed in the machine at the factory or, in the case of updates, shipped to the customer or service personnel for re-installation in the machine. An alternative method of encoding or updating prestored parameters may be utilized in discrimination machines employing "flash card" technology, such as described in U.S. Pat. No. 5,909,502 assigned to the assignee of the present invention and incorporated herein by reference in its entirety. In such a "flash card" loading system, a flash card is programmed with the desired code and the machine may be encoded or updated by inserting the flash card into the machine, causing the system memory to become replaced with the flash card memory. Nevertheless, in either of the above prior systems, the source of the code is external to the machine, typically the code is entered at the factory or service center level. Moreover, the discrimination capability of a particular machine is limited to only those bills associated with the pre-stored master information with which it has been programmed.

Accordingly, in view of the above, there is a need for a document handling system that is able to accommodate a variety of documents such as currencies of several denominations and types, including multiple denominations and types of currencies from multiple countries, including the multiple types of "Euro" currencies to be issued by the various European countries, casino scripts, or the like without having been externally programmed or updated with pre-stored master information associated with those denominations and types. The present invention is directed to satisfying these needs.

SUMMARY OF THE INVENTION

In accordance with one aspect of the present invention, a document handling system for evaluating documents with respect to master information, the document handling system being operable in a learn mode and a standard mode, the document handling system comprising at least one input device adapted in the learn mode to obtain from an authentic document master information associated with one or more attributes of the authentic document, a memory for storing the master information obtained from at least one master document of each of at least two different types, and an operator actuatable selector for selecting the learn mode.

In accordance with another aspect of the present invention, a document handling method comprising the steps of obtaining master information associated with one or more attributes of at least one master documents, and storing data related to the master information obtained from at least two documents of different types in a resident memory.

In accordance with another aspect of the present invention, a document handling system for evaluating documents with respect to independently derived master information, the document handling system being operable in a learn mode and a standard mode, the document handling system comprising at least one sensor, adapted in the learn mode to obtain from a master document, master information associated with one or more attributes of the master document, the sensor being adapted in the standard mode to obtain from test documents, test data associated with one or more attributes of the test documents, a processor, adapted in the standard mode to evaluate each of the test documents comparing the test data associated with a selected one of the attributes to the master information corresponding to the selected one of the attributes, a memory for storing the master information obtained from at least one document of each of at least two different types, and an operator actuable selector for alternatively selecting the learn mode and the standard mode.

In accordance with yet another aspect of the present invention, a document handling machine operable in a learn mode and a standard mode, the document handling machine comprising at least one learn mode sensor adapted in the learn mode to scan a master document and to obtain master information associated with the master document, a memory for storing the master information associated with master documents of at least two different types, one or more standard mode sensors adapted in the standard mode to scan a test document to obtain test data associated with the test document, and a processor adapted in the standard mode to compare the test data to the master information.

In accordance with yet another aspect of the present invention, a document handling machine operable in a learn mode and a standard mode, the document handling machine comprising an input receptacle for receiving documents, the documents including in the learn mode at least one master document of a first type and at least one master document of a second type, the documents including in the standard mode at least one testdocument, an output for receiving in the learn mode the master documents and for receiving in the standard mode the test documents, a transport mechanism for transporting in the learn mode the master documents and for transporting in the standard mode the test documents, from the input receptacle to the output receptacle along a transport path, one or more sensors positioned along the transport path between the input receptacle and the output receptacle, the sensors including a learn mode sensor adapted in the learn mode to scan the master documents to obtain master information associated with the master documents and a standard mode sensor adapted in the standard mode to scan the test documents to obtain test data associated with the test documents, a memory for storing the master information, and a processor adapted in the standard mode to evaluate a test document by comparing the test data to the master information.

In accordance with yet another aspect of the present invention, a document authenticating machine operable in a learn mode and a standard mode, the document authenticating machine comprising at least one learn mode sensor adapted in the learn mode to scan a master document and to obtain master information associated with the master document, a memory for storing the master information associated with master documents of at least two different types, one or more standard mode sensors adapted in the standard mode to scan a test document to obtain test data associated with the test document, and a processor adapted in the standard mode to determine the authenticity of the test document by comparing the test data to the master information.

In accordance with yet another aspect of the present invention, a method of evaluating documents comprising the steps of obtaining master information associated with each of a plurality of types of master currency bills, storing the master information, obtaining test data associated with one or more test bills, and evaluating of the test bills using the test data and the master information.

In accordance with yet another aspect of the present invention, a document evaluation device operable in a learn mode to process bills and acquire master information from the documents, the currency evaluation device comprising an input receptacle for receiving documents to be processed in the learn mode, an output receptacle for receiving the documents after the documents have been processed in the learn mode, a transport mechanism for transporting the documents in the learn mode from the input receptacle to the output receptacle along a transport path, one or more sensors positioned along the transport path between the input receptacle and the output receptacle, the sensors being adapted in the learn mode to scan the documents processed in the learn mode to obtain master information associated with one or more attributes of the documents, and a memory for storing in the learn mode the master information obtained from the documents.

BRIEF DESCRIPTION OF THE DRAWINGS

The foregoing and other advantages of the invention will become apparent upon reading the following detailed description and upon reference to the drawings in which.

Figure 1:
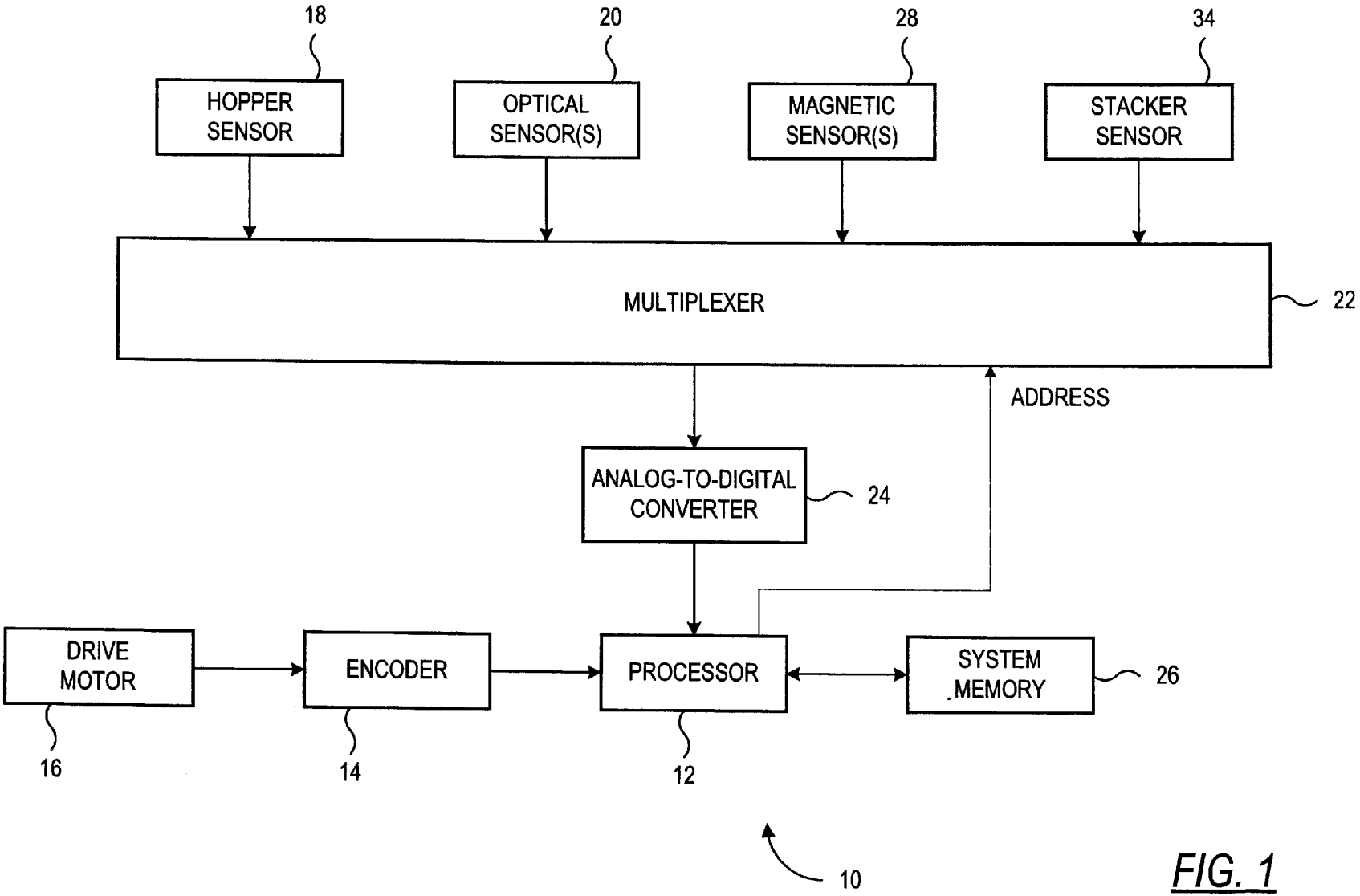
FIG. 1 is a block diagram of a document handling system embodying principles of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Referring to the drawings, FIG. 1 shows a block diagram of a document handling system 10 embodying principles of the present invention. The document handling system 10 may include a counter or a denomination discriminator, generally of the type described above, or an "enhanced counter" generally of the type described below.

In addition to the denomination discriminators which can accurately call the denomination of bills being processed and note counters which do not discriminate the denomination of the bills being processed, another type of currency handling machine similar to traditional note counter may employ relatively simple means to determine the denomination of a bill. This type of machine, hereinafter designated an "enhanced note counter" or simply "enhanced counter," may include sensors sufficient to enable it to preliminarily discriminate the denomination of a bill and also sensors such as magnetic or optical sensors sufficient to enable it to discriminate between acceptable and non-acceptable bills (including counterfeit bills) in a stack of bills. For example, an enhanced counter may employ size detecting sensors to measure the length and/or width of a bill being processed. The enhanced counter may further comprise a memory storing master information indicating the sizes of different types of bills, for example, the sizes of different denominations of British pounds. If then measured size of the test bill sufficiently matches one of the stored master sizes, then the enhanced counter can make a preliminary determination of the denomination of the bill. The denomination determination test is preliminary because it simply indicates that the size of the document being processed matches one of the master sizes. However, a blank piece of paper cut to appropriate size would also satisfy such a test. Hence such an enhanced note counter does not provide sufficient testing to be relied on to "call" or authenticate the denomination and type of processed documents but nonetheless may prove useful in certain currency processing contexts. Additionally, such preliminary denomination determination systems may be employed in conjunction with denomination discriminators whereby a preliminary determination of the denomination is initially made and then further denomination discrimination is performed using the results of the preliminary denomination determining step.

A controller or processor 12, such as a microprocessor, CPU, or the like, controls the overall operation of the document handling system 10. It should be noted that the detailed construction of a mechanism to convey documents such as currency bills through the document handling system 10 is not related to the practice of the present invention. Many configurations are well-known in the prior art. An exemplary configuration includes an arrangement of pulleys and rubber belts driven by a single motor, as shown in U.S. Pat. No. 5,295,196, assigned to the assignee of the present invention and incorporated herein by reference. An encoder 14 may be used to provide input to the processor 12 based on the position of a drive shaft 16, which operates the bill-conveying mechanism. The input from the encoder 14 allows the microprocessor to calculate the position of a document such as a currency bill as it travels and to determine the timing of the operations of the document handling system 10.

A stack of documents such as currency bills (not shown) may be deposited in a hopper 18 which holds the currency securely and allows the bills in the stack to be conveyed one at a time through the document handling system 10. After the bills are conveyed to the interior of the document handling system 10, a portion of the bill may be optically or magnetically scanned by respective optical sensor(s) 20 and/or magnetic sensor(s) 28 of types commonly known in the art. The optical sensor(s) 20 generate signals that correspond to the amount of light reflected by all or part of the bill, while the magnetic sensor(s) 28 are designed to detect the amount or pattern of magnetic ink on all or part of the bill.

One form of document handling system using optical sensors to detect patterns of light reflected from the surface of bill(s) is described in U.S. Pat. No. 5,687,963, entitled "Method and Apparatus for Discriminating and Counting Documents," incorporated herein by reference in its entirety. Another form of document handling system using optical sensors to detect reflected ultraviolet light (UV) and emitted flourescent light is described in U.S. Pat. No. 5,790,693, assigned to the assignee of the present invention and incorporated herein by reference. A document handling system using magnetic sensors is described in U.S. Pat. No. 5,295,196, assigned to the assignee of the present invention and incorporated herein by reference in its entirety.

Figure 2:
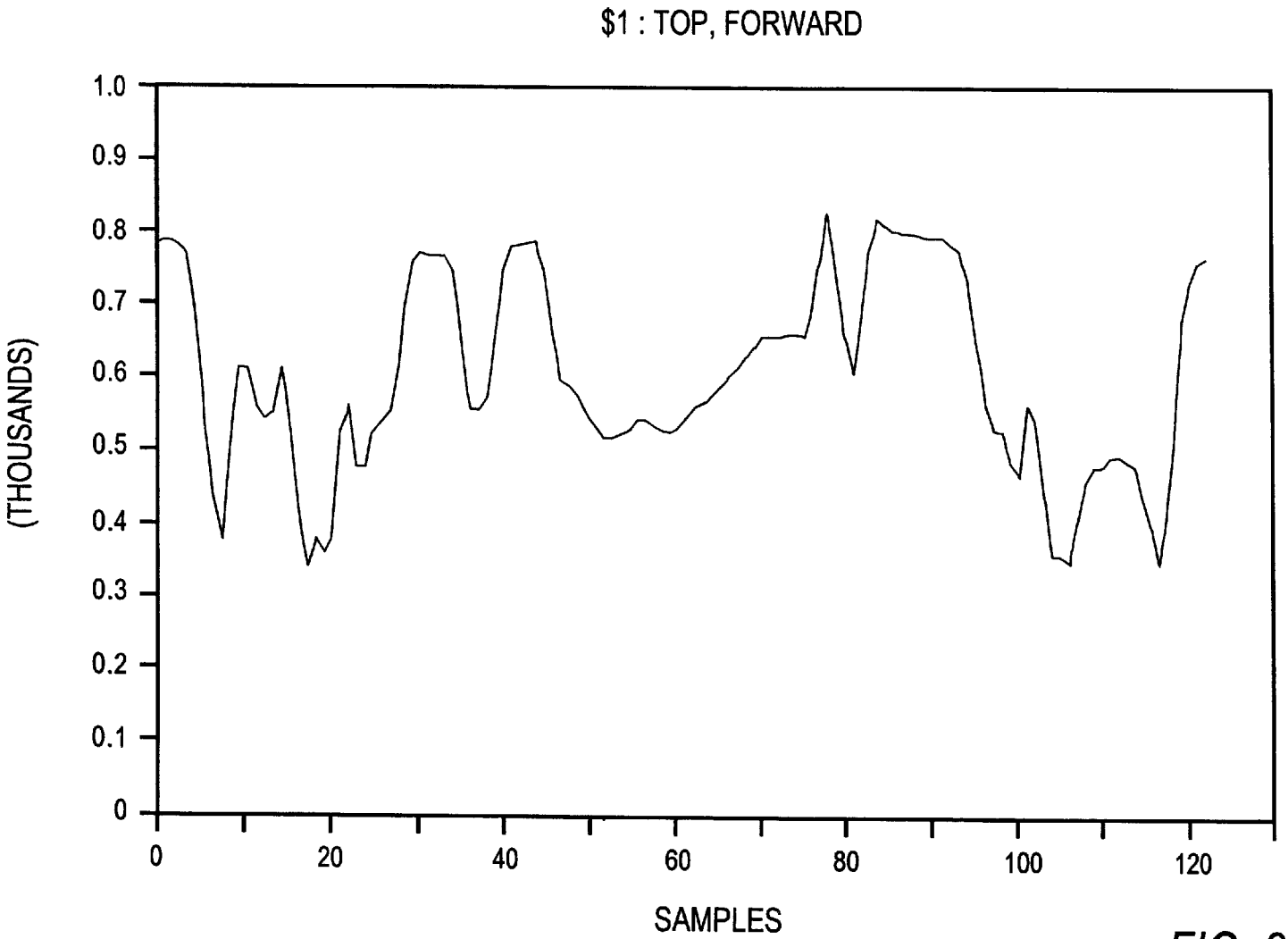
FIG. 2 is a graphical illustration of representative characteristic patterns generated by optical scanning of a U.S. $1 currency bill.

The fraction of bill that is scanned by the sensors 20, 28 may be less than the entire area of one side of the bill. The scanned area may be less than half, or even less than one quarter, of the area of one side of the bill. In the case of U.S. currency, for instance, it has been determined that scanning a central, approximately one-half inch portion of either side of the bills, along the narrow dimension of the bills, provides reflectance data sufficient to distinguish among the various U.S. currency denominations. FIG. 2 is an example of a pattern obtained by optically scanning the "green" side of a U.S. $1 bill (using 64 reflectance samples) across this central half-inch section.

Signals from the optical or magnetic sensors 20, 28, properly amplified, are sent to an analog-to-digital converter (ADC) 24 via a multiplexer 22. The output of the ADC is read by the processor 12. The processor 12 stores each element of data from the optical and/or magnetic sensors 20, 28 in a system memory 26, forming a set of data values corresponding to the optical and/or magnetic scan of the representative currency bills. The system memory 26 may comprise any combination of random access memory (RAM), read only memory (ROM), flash memory or any other memory type known in the art.

It will be appreciated that sensors other than magnetic and optical sensors may be used in the document handling system 10, without departing from the invention. For example, other techniques of gathering test data from currency include electrical conductivity sensing, capacitive sensing (U.S. Pat. No. 5,122,754 [watermark, security thread]; 3,764,899 [thickness]; 3,815,021 [dielectric properties]; 5,151,607 [security thread]), and mechanical sensing (U.S. Pat. No. 4,381,447 [limpness]; 15 4,255,651 [thickness]).

The document handling system 10 may be operated in a "standard" currency evaluation mode or in a "learn" mode. In the standard currency evaluation mode, the optical and/or magnetic data obtained by the optical and/or magnetic sensor(s) 20, 28 is compared by the processor 12 to prestored master information stored in the system memory 26. The prestored master information corresponds to optical and/or magnetic data generated from genuine "master" currency of a plurality of denominations and/or types. Typically, the prestored data represents expected numerical values, ranges or patterns of numerical values associated with optical and/or magnetic scans of genuine currency. The master information may further represent various orientations and/or facing positions of genuine currency to account for the possibility of a bill in the stack being in a reversed orientation or reversed facing position compared to other bills in the stack. A document handling system utilizing prestored master information is described in U.S. Pat. No. 5,295,196, incorporated herein by reference.

The document handling system 10 may make a determination of authenticity or denomination of a bill under test by comparing test data obtained from scanning the test bill to master information stored in the system memory 26. The test data may comprise any of the several types of data identified above. The master information may comprise data associated with, generated and/or derived from "master" currency of a plurality of denominations and/or types. A determination of denomination of test bills may be made, for example, in a denomination discriminator by scanning test bills having an initially unknown denomination to obtain test data, then comparing the test data to prestored master information associated with a plurality of denominations of bills. The document handling system 10 may determine in such comparison whether the test data sufficiently matches any item of master information corresponding to a particular bill. If there is a sufficient match, the document handling system 10 may determine the denomination of the test bill to be the same as that associated with the matching master information.

In contrast, a typical counter is designed to accommodate a stack of bills having the same, predetermined denomination. A typical counter thereby does not determine the denomination of the bills under test, but determines the authenticity of the bills after having been informed of the denomination and/or type of the bills by an external signal or operator. The denomination of the bills under test may be communicated to the counter through an operator interface panel such as a keyboard or touchscreen, or through a remote host system linked to the document handling system, such as that described in U.S. patent application Ser. No. 08/722,808, filed Sep. 27, 1996 and entitled "Currency Handling System that Communicates with an External Device" assigned to the assignee of the present invention and incorporated herein by reference.

In addition to the denomination discriminators which can accurately call the denomination of bills being processed and note counters which do not discriminate the denomination of the bills being processed, another type of document handling machine similar to the traditional note counter may employ rather crude means to determine the denomination of a bill. This type of machine, hereinafter designated an "enhanced note counter" or simply "enhanced counter," may include sensors sufficient to enable it to crudely discriminate the denomination of a bill and also sensors such as magnetic or optical sensors sufficient to enable it to discriminate between acceptable and non-acceptable bills (including counterfeit bills) in a stack of bills. For example, an enhanced counter may employ size detecting sensors to measure the length and/or width of a bill being processed. The enhanced counter may further comprise a memory storing master information indicating the sizes of different types of bills, for example, the sizes of different denominations of British pounds. If then measured size of the test bill sufficiently matches one of the stored master sizes, then the enhanced counter can make a preliminary determination of the denomination of the bill. The denomination determination test is rather crude because it simply indicates that the size of the document being processed matches one of the master sizes. Thus, a blank piece of paper cut to appropriate size would satisfy such a crude test. Hence, such an enhanced note counter does not provide sufficient testing to be relied on to call the denomination and type of processed documents but nonetheless may prove useful in certain currency processing contexts. Additionally, such crude denomination systems may be employed in conjunction with denomination discriminators whereby a crude determination of the denomination is initially made and then further denomination discrimination is performed using the results of the crude denomination determining step.

According to one embodiment of the present invention, the operator of a document handling device such as a note counter (traditional or "enhanced") or a currency denomination discriminator is provided with the ability to set sensitivity levels to perform various standard mode authentication tests. The standard mode authentication tests may include, for example, a UV test (upper and lower), a flourescence test and a magnetic test, such as described in U.S. patent application Ser. No. 08/798,605, filed Feb. 11, 1997, entitled "Method and Apparatus for Authenticating Currency," assigned to the assignee of the present invention and incorporated herein by reference. The sensitivity levels may be set through an operator interface panel such as a keyboard or touchscreen, or through a remote host system. More particularly, in one embodiment, the operator is provided with the ability to adjust either of the four authentication tests noted above in a range of sensitivities 1–10, with 10 being the most sensitive, or to turn each test off. This permits an operator to vary the sensitivity according to the denomination and/or type of bill. For example, an operator may choose to select a low sensitivity in the authentication of low denomination bills and a high sensitivity in the authentication of high denomination bills. The above setting options are summarized in Table 1.

TABLE 1

| Mode | Uv Test -- Lower Sensitivity | UV Test -- Upper Sensitivity | Fluorescent Test Sensitivity | Magnetic Test Sensitivity |
|---|---|---|---|---|
| High | Off, 1-10 | Off, 1-10 | Off, 1-10 | Off, 1-10 |
| Low | Off, 1-10 | Off, 1-10 | Off, 1-10 | Off, 1-10 |
| 1,2,5,10,20,50,100 | Off, 1-10 | Off, 1-10 | Off, 1-10 | Off, 1-10 |

According to an alternate embodiment, the above high/low modes are replaced with denomination modes, for example, one for each of several denominations of currency (e.g., $1, $2, $5, $10, $20, $50 and $100). For each denomination, the 5 sensitivity of the four tests may be adjusted between 1–10 or off. According to one embodiment, the operator manually selects either the high or low mode or the appropriate denomination mode based on the values of the notes to be processed. This manual mode selection system may be employed in, for example, a traditional note counter, enhanced note counter or a currency denomination discriminator.

In the low mode or for low denomination modes (e.g., $1, $2) the three tests may be set to relatively low sensitivities (e.g., UV test set at 2, fluorescent test set at 5, and magnetic test set at 3). Conversely, in the high mode or for high denomination modes (e.g., $50, $100) the three tests may be set to relatively high sensitivities (e.g., UV test set at 5, fluorescent test set at 6, and magnetic test set at 7). In this way, authentication sensitivity may be increased when processing high value notes where the potential harm or risk in not detecting a counterfeit may be greater and may be decreased when processing low value notes where the potential harm or risk in not detecting a counterfeit is lesser and the annoyance of wrongly rejecting genuine notes is greater. Also the UV, fluorescent, and/or magnetic characteristics of genuine notes can vary due to number of factors such wear and tear or whether the note has been washed (e.g., detergents). As a result, the fluorescence detection of genuine U.S. currency, for example, may yield readings of about 0.05 or 0.06 volts.

With respect to U.S. currency, the UV and fluorescent thresholds associated with each of the ten sensitivity levels may be set, for example, as shown in Table 2.

TABLE 2

| Sensitivity Level | UV Test -- Lower (Volts) | UV Test -- Upper (Volts) | Fluorescence Test (Volts) |
|---|---|---|---|
| 1 | 0.200 | 2.200 | 0.800 |
| 2 | 0.325 | 2.100 | 0.600 |
| 3 | 0.450 | 2.000 | 0.400 |
| 4 | 0.550 | 1.900 | 0.200 |
| 5 | 0.600 | 1.800 | 0.150 |
| 6 | 0.650 | 1.700 | 0.100 |
| 7 | 0.700 | 1.600 | 0.090 |
| 8 | 0.750 | 1.500 | 0.080 |
| 9 | 0.800 | 1.450 | 0.070 |
| 10 | 0.850 | 1.400 | 0.060 |

Although the UV and flourescence threshold data associated with sensitivity levels 1–10 in Table 2 are derived with respect to U.S. currency, it will be appreciated that the sensitivity levels may be appropriately selected to authenticate foreign currency or other documents having known reflectance characteristics.

According to one embodiment of the present invention, the document handling system automatically selects either the high or low mode or the appropriate denomination mode based on the values of the notes being processed. This automatic mode selection system may be employed in systems capable of independently identifying the different values or kinds of documents, such as a denomination discriminator or enhanced note counter, or in systems which do not identify but which are externally informed of the denomination of documents to be processed, such as a traditional note counter.

In one embodiment, where a currency evaluation machine capable of denominating bills (e.g., a denomination discriminator or enhanced note counter) is presented with a stack of bills, each having the same denomination, the machine evaluates one or more test bills in the stack to identify their denomination, automatically selects a sensitivity setting corresponding to the identified denomination, and evaluates the remaining bills in the stack according to the same sensitivity setting, without reaccomplishing the selection of a sensitivity setting for each individual bill. This embodiment reduces the processing burden on the machine and can enable the machine to process bills with greater speed than would otherwise be achievable by continuously re-evaluating the sensitivity setting. It will be appreciated, however, that the automatic mode selection system may be used to select an authentication mode independently for each bill in the stack, regardless of whether the bills are known to have the same or different denominations, with sensitivity settings which may vary according to the different denominations and types of bills in the stack.

In one embodiment, where each bill in the stack is the same denomination and type (but where the denomination discriminator or enhanced note counter has not been informed of the denomination and type), the denomination discriminator or enhanced counter makes an initial determination of the denomination and type of the bills in the stack by scanning one or more test bills to determine one or more selected attributes of the bill(s) such as, for example, the size or color of the bill(s), then compares the selected attribute(s) to master information corresponding to the selected attribute (s) in various denominations and types of currency. The denomination and type of the test bill(s) is determined by finding the denomination of currency whose master information most closely compares to the selected attribute(s) of the bill under test. Then, because the remaining bills in the stack are known to be generally the same denomination and type as the test bill(s), the discriminator or enhanced counter assumes the denomination and type of the remaining bills in the stack to be the same as that of the test bill(s). In this embodiment, therefore, an initial determination of denomination and type of the remaining bills is accomplished automatically in response to evaluation of the test bill(s) without separately discriminating the denomination and type of the remaining bills. Operating parameters may then be selected, either manually or automatically, corresponding to the assumed denomination and type of the bills, and the authenticity of the bills may be determined by the standard mode of operation described above. The selection of operating parameters may comprise, for example, the setting of sensitivity levels, displays, the selection of sensor(s) or generally any feature that may be varied in response to different denominations and types of currency.

Similarly, where each bill in the stack is the same denomination and type and where the denomination discriminator or counter has been informed of the type, but not denomination, of the bills, the denomination discriminator or enhanced counter makes an initial determination of the denomination of the bills in the stack by scanning one or more test bills to determine one or more selected attributes of the bill(s) such as, for example, the size or color of the bill(s), then compares the selected attribute(s) to master information corresponding to the selected attribute(s) in the various denominations of the known type of currency. The denomination of the test bill(s) is determined by finding the denomination of currency whose master information most closely compares to the selected attribute(s) of the bill under test. Then, because the remaining bills in the stack are known to be generally the same denomination as the test bill(s), the discriminator or enhanced counter assumes the denomination of the remaining bills in the stack to be the same as that of the test bill(s), without separately discriminating the remaining bills. Operating parameters may then be selected, either manually or automatically, corresponding to the assumed denomination and known type of the bills, and the authenticity of the bills may be determined by the standard mode of operation described above.

For example, suppose that a denomination discriminator or enhanced counter is presented with a stack of 5£ British currency notes after having been informed of the type, but not denomination, of the bills. According to one embodiment of the present invention, the denomination discriminator or enhanced counter makes an initial determination of the denomination of the stack of bills by scanning a first bill to derive a numerical test value corresponding to the size of the first bill, then compares the numerical test value to a set of master information stored in system memory. The master information may comprise numerical values corresponding to the respective sizes of various denominations of British currency, including 5£, 10£, 20£, 50£ and 100£ British notes. The denomination of the first bill (and the assumed denomination of the remainder of the stack) is chosen from among the several denominations of British currency corresponding to the threshold values by determining which one of the stored numerical values most closely matches the test value obtained from the first bill. Thus, in the present example, the first bill (and expected denomination of the remainder of the stack) will most likely be determined to be a 5£ British note.

Based on this initial determination, the denomination discriminator or enhanced counter may determine the authenticity of the remaining bills in the stack with operating parameters (e.g., authentication sensors, sensitivity settings, operator interface panel) tailored for the authentication of 5£ British notes. The determination of authenticity of the remainder of the test bills may be made by comparing any appropriate authentication attribute of the bills to corresponding master information in the system memory, notwithstanding the attribute used to make the initial determination of denomination. Thus, in the present example, although the attribute used to make the initial determination of denomination is, for example, size, the authenticity of the remaining bills may be made by comparing any appropriate attribute of the bills, such as size, magnetic content, UV reflectance levels, etc. to corresponding master information associated with 5£ British notes.

Heretofore, the master information used in evaluating currency in "standard" mode has been generated externally to the document handling system 10. The master information is typically programmed at a factory or service center into a memory device such as an EPROM, then installed in the machine or shipped to the user for installation in the machine. Consequently, the ability of document handling machines known in the art to discriminate or authenticate particular types and/or denominations of currency is dependent on the content of their associated memory device. The memory devices must therefore be appropriately encoded to correspond to the intended market in which they will be used. For example, a memory device to be used in a machine for discriminating U.S. currency must be encoded with master information corresponding to the magnetic or optical characteristics of U.S. currency, while a memory device used in a machine designated for foreign markets must be encoded with master information corresponding to the magnetic or optical characteristics of the appropriate foreign currency(s). A machine having a memory device encoded with master information appropriate to one market will generally be unable to accommodate currency from another market because it has not been encoded with the appropriate master information for that other market.

In the "learn" mode, the present invention is designed to overcome the problems associated with the prior art by permitting the document handling system 10 to generate the necessary master information independently, without having been pre-programmed with such master information. According to one embodiment, in each operation of the learn mode, one or more representative "master" currency bills of a designated currency denomination and type is deposited in the hopper 18 and fed through the system 10 as described above. While several master bills may be used to "learn"

density, UV, and magnetic characteristics, usually a single bill is used to learn reflected "pattern" characteristics. The denomination and/or type of the master currency bills may be initially unrecognizable to the document handling system 10. As the master currency bills are conveyed through the document handling system 10, they are scanned by one or more discrimination and/or authentication sensors and master information corresponding to the scan of the master bills is stored in a system memory 26. With each operation of the learn mode, the system memory increases its store of master information. Thus, where the system memory 26 initially stores a first set of master information (e.g., associated with U.S. currency), the learn mode may be executed to learn new series of bills (e.g., new series of U.S. $50 bills), currency from other countries or specialized currency such as might be used by a casino, amusement park or the like. Regardless of the type of currency which is learned, the master information obtained in learn mode will supplement, rather than replace the first set of master information. The master information is available for recall from the memory 26 for subsequent comparison to test data obtained from bills to be denominated and/or authenticated by the document handling system 10 in "standard" mode.

In the embodiment shown in FIG. 1, the sensors comprise optical and magnetic sensors 20, 28. The attributes of a bill for which data may be obtained from magnetic sensing include, for example, patterns of changes in magnetic flux (U.S. Pat. No. 3,280,974), patterns of vertical grid lines in the portrait area of bills (U.S. Pat. No. 3,870,629), the presence of a security thread (U.S. Pat. No. 5,151,607), total amount of magnetizable material of a bill (U.S. Pat. No. 4,617,458), patterns from sensing the strength of magnetic fields along a bill (U.S. Pat. No. 4,593,184), and other patterns and counts from scanning different portions of the bill such as the area in which the denomination is written out (U.S. Pat. No. 4,356,473).

The attributes of a bill for which data may be obtained from optical sensing include, for example, density (U.S. Pat. No. 4,381,447), color (U.S. Pat. Nos. 4,490,846; 3,496,370; 3,480,785), length and thickness (U.S. Pat. No. 4,255,651), the presence of a security thread (U.S. Pat. No. 5,151,607) and holes (U.S. Pat. No. 4,381,447), reflected or transmitted intensity levels of UV light (U.S. Pat. No. 5/640,463) and other patterns of reflectance and transmission (U.S. Pat. Nos. 3,496,370; 3,679,314; 3,870,629; 4,179,685). Color detection techniques may employ color filters, colored lamps, and/or dichroic beamsplitters (U.S. Pat. Nos. 4,841,358; 4,658,289; 4,716,456; 4,825,246, 4,992,860 and EP 325, 364).

Alternatively or additionally, a variety of other sensors may be utilized to process currency to obtain master information or test data including, for example, electrical conductivity sensors, capacitive sensors (U.S. Pat. Nos. 5,122, 754 [watermark, security thread]; 3,764,899 [thickness]; 3,815,021 [dielectric properties]; 5,151,607 [security thread]), and mechanical sensors (U.S. Pat. Nos. 4,381,447 [limpness]; 4,255,651 [thickness]).

According to one embodiment of the present invention, the master information comprises numerical data associated with various denominations of currency bills. The numerical data may comprise, for example, thresholds of acceptability to be used in evaluating test bills, based on expected numerical values associated with the currency or a range of numerical values defining upper and lower limits of acceptability. The thresholds may be associated with various sensitivity levels, as described in relation to Table 1 and Table 2. Alternatively, the master information may comprise non-numerical information associated with the currency such as, for example, optical or magnetic patterns, symbols, codes or alphanumeric characters. In either case, the master information comprises internally generated parameters which may be used in evaluating test bills in the same manner described above in relation to the standard mode of operation.

Master information may be obtained in the learn mode from any of several currency denominations and/or types. The learn mode may be repeated in successive trials to accumulate master information from multiple currency denominations and/or types. For example, in a first operation of the learn mode, master currency bills of a first currency denomination and type may be conveyed through the document handling system 10 and processed to obtain master information associated with the first currency denomination and type, which may then be stored in the system memory 26. Then, in a second operation of the learn mode master currency bills of a second currency denomination and type may be conveyed through the document handling system 10 and processed to obtain master information associated with the second currency denomination and type, which also may be stored in the system memory 26. This process may be repeated several times to obtain master information associated with multiple denominations and types of currency. The information associated with each of the currency denominations and types is stored in system memory 26 for recall in "standard" mode, as heretofore described.

The specific denominations and types of currency from which master information may be expected to be obtained for any particular machine 10 will generally depend on the market in which the machine 10 is used (or intended to be used). In European market countries, for example, with the advent of Euro currency (EC currency), it may be expected that both EC currency and a national currency will circulate in any given country. In Germany, for a more specific example, it may be expected that both EC currency and German deutschmarks (DMs) will circulate. With the learn mode capability of the present invention, a German operator may obtain master information associated with both EC and DM currency and store the information in system memory 26.

Of course, the "family" of desirable currencies for any particular machine 10 or market may include more than two types of currencies. For example, a centralized commercial bank in the European Community may handle several types of currencies including EC currency, German DMs, British Pounds, French Francs, U.S. Dollars, Japanese Yen and Swiss Francs. In like manner, the desirable "family" of currencies in Tokyo, Hong Kong or other parts of Asia may include Japanese Yen, Chinese Remimbi, U.S. Dollars, German DMs, British Pounds and Hong Kong Dollars. As a further example, a desirable family of currencies in the United States may include the combination of U.S. Dollars, British Pounds, German DMs, Canadian Dollars and Japanese Yen. With the learn mode capability of the present invention, master information may be obtained from any denomination of currency in any desired "family" by simply repeating the learn mode for each denomination and type of currency in the family.

The anticipated "Euro" denominations may have a common "front" face for all issuing countries; however, it is presently contemplated that each issuing country may provide its own "ream" face for each denomination. Thus, the several "Euro" bills issued by each or by several or by all different member countries may form other such "families" of currencies, or be a part of still other "families" which include other currencies. For example, a German bank may process German marks, and also "Euro" bills issued by Germany, as well as by one or more other European countries.

This may be achieved in successive operations of the learn mode by running currency bills of the designated family, one currency denomination and type at a time, past the sensors of the system 10 to obtain the necessary master information. The currency bills may be fed individually through the system 10 or in stacks of the designated denomination and/or type depending on the characteristic to be "learned," as mentioned above. The number of bills fed through the system may thereby be as few as one bill, or may be several bills. The bill(s) fed through the system may include good quality bill(s), poor quality bill(s) or both. The master information obtained from the bills defines (or may be processed to define) thresholds, ranges of acceptability or patterns of bills of the designated denomination and type which are later to be evaluated in "standard" mode.

For example, suppose a single good quality bill of a designated denomination and type is fed through the system 10 in learn mode. The master information obtained from the bill may be processed to define a range of acceptability for bills of the designated denomination and type. For instance, the master information obtained from the learn mode bill may define a "center" value of the range, with "deltas," plus or minus the center value being determined by the system 10 to define the upper and lower bounds of the range. Alternatively, a range of acceptability may be obtained by feeding a stack of bills through the system 10, each bill in the stack being of generally "good" quality, but differing in degree of quality from others in the stack. In this example, the average value of the notes in the stack may define a "center value" of a range, with values plus or minus the center value defining the upper and lower bounds of the range, as described above. Alternatively, other statistical analysis may be employed to define thresholds, patterns or ranges, such as standard deviation information being used to define upper and lower bounds of the range.

In another embodiment, master information obtained from the poorest quality of the learn mode bills may be used to define the limits of acceptability for bills of the designated denomination and type, such that bills of the designated denomination and type evaluated in standard mode will be accepted if they are at least as "good" in quality as the poorest quality of the learn mode bills. Still another alternative is to feed one or more poor quality bills through the system 10 to define "unacceptable" bill(s) of the denomination and type, such that bills of the designated denomination and type evaluated in standard mode will not be accepted unless they are better in quality than the poor quality learn mode bills.

Because the currency bills are initially unrecognizable to the document handling system 10 in the learn mode, the operator must generally inform the system 10 (by means of operator interface panel or external signal, for example) which denomination and type of currency it is "learning" and whether it is learning a good quality (e.g., "acceptable") or poor quality (e.g., "marginally acceptable" or "unacceptable") bill so that the system 10 may correlate the master information it obtains (and stores in memory) with the appropriate denomination, type and acceptability status of the bill(s).

In one embodiment, various menu displays may be utilized at the operator interface panel to prompt the operator to enter the country, denomination and/or series of the currency to be "learned" in learn mode. The learn mode menu may also prompt the operator to select the type of tests to perform in learn mode.

The available selection options in the menu may be predetermined "default" settings or customizable settings programmed into the system 10 in a set-up mode. In one embodiment, for example, a country selection sub-menu may offer United States, Canada and Mexico as country selection options, a denomination selection sub-menu may offer the units 1, 2, 3, 4, 5, 10, 20, 50 and 100 as denomination selection options, a series selection sub-menu may offer the units 1, 2 and 3 as series selection options, and a test selection menu may offer optical pattern, UV, magnetic, thread detection, size detection and color as test selection options.

In one embodiment, user-defined labels and settings may be entered into the system 10 to accommodate new countries, types or denominations of currency. The operator may enter labels and selection options appropriate to the new type of currency through the learn mode menu, or may define a tailored learn mode menu appropriate to the new currency in a set-up mode of the machine. The available menu selection options may include denomination selection options and test selection options as heretofore described. The user-defined option may be used, for example, where a machine 10 will be instructed to learn a specialized form of currency, such as might be used by a casino, amusement park, or the like. In such case, rather than selecting a country, the operator may enter a label (e.g., Skyline casino) identifying the type of money via keyboard, touchscreen, or other appropriate means. Then, the operator may select the denomination(s) and/or series of the currency to be learned, and perhaps the test(s) to be performed, through the learn mode menu as heretofore described.

The user may select from among the available menu or sub-menu options by "clicking" over an appropriate icon, pressing a touch screen or some other means. The denomination, series and/or test selection menus may offer selection options tailored to the country or denominations which have been selected. Thus, for example, where the United States has been selected in the country selection menu, the denomination selection menu may offer $1, $5, $10, $20, $50 and $100 as available denomination selection options and the test selection menu may offer optical pattern, UV, magnetic, and thread detection as test selection options. Similarly, where the United States has been selected in the country selection menu and $50 has been selected in the denomination selection menu, the series selection menu may offer "1998–" and "1998+" (or "old" and "new") as available series selection options.

For purposes of illustration, suppose that an operator desires to obtain master information for new series $50 U.S. bills. In one embodiment, this may be achieved by first instructing the machine 10, by means of an operator interface panel or external signal, to enter the learn mode and then, through the appropriate menu(s), selecting a country, denomination and series of currency to be learned (e.g., "United States," "$50," "1998+"). Through the test selection menu, the operator may instruct the machine 10 which type of test(s) to perform to obtain the master information. The operator may then insert a single good-quality bill of the selected denomination and type (or a number of such bills) in the hopper 18. The machine 10 feeds the bill(s) through the system and evaluates the bills with sensors appropriate to the selected test(s) to obtain master information associated with the bills. The master information is stored in the system memory and is retrievable for later use in standard mode to denominate and/or authenticate bills corresponding to the learned denomination.

Where a single bill is fed through the system 10, suppose that an arbitrary value "x" is obtained from the learn mode sensors. The sytem 10 may define the value "x" to be a center value of an "acceptable" range for $50 dollar 1988 series U.S. bills. The system 10 may further define the values "x+y" and "x−y" to comprise the upper and lower bounds of the "acceptable" range for $50 dollar 1988 series U.S. bills, where y is a tolerance value appropriate to the type of test. An appropriate value of y may be derived in relation to the value x (e.g., in terms of standard deviation) or may be independent of x. The value of y may differ according to the type of test employed and the different results which may be expected from the tests. For example, for two tests A and B, an appropriate value of y may be 0.1 volts for test A and 0.01 volts for test B.

Alternatively, especially where the bills to be "learned" have been subject to varying degrees of circulation, the ranges of acceptability may be derived from an average sensor value obtained from multiple bills. Suppose, for example, an operator wishes to teach the machine 10 master information associated with U.S. $5 dollar bills. The user may feed multiple $5 dollar bills, each bill being of generally "good" quality but having been subject to varying degrees of circulation, through the system 10, (and again using the arbitrary sensor value "x" for purposes of illustration), suppose that the average sensor value obtained from the bills is "1.1x". The system 10 may define the "acceptable" range for $5 dollar U.S. bills to be centered at the average sensor value "1.1x," with a tolerance value "y" substantially as described above defining in this case an upper bound "1.1x+y" and a lower bound "1.1x−y" of acceptability. As a further alternative, where multiple bills (e.g., $5 dollar U.S. bills) are fed through the system 10, suppose that sensor values obtained in the learn mode range between "1.4x" and "0.9x". The system 10 may define the values "1.4x" and "0.9x" to be the upper and lower bounds of the "acceptable range" for $50 dollar 1988-series U.S. bills, without regard to the average value.

According to one embodiment, the operator includes in the stack of master currency to be processed both new, uncirculated currency and bills which have been in circulation to varying degrees. In this embodiment, bills of the poorest quality may be fed through the system to define the outer limits of acceptability of the bills. For example, suppose that the operator feeds two poor quality U.S. $5 dollar bills through the system 10, and suppose that sensor readings of "1.5x" and "0.7x" are obtained from the poor quality bills. The system 10 may then determine the range of acceptability for U.S. $5 dollar bills to be between the values of "0.7x" and "1.5x."

Next, after master information has been obtained from the first denomination and type of currency (e.g., U.S. $5 dollar bills), the operator instructs the system 10 that it will be reading a second, third, fourth, etc. denomination and type of currency (e.g., $10 denominations of U.S. currency, $5 and $10 denomination of Canadian currency, etc.), then feeds the respective bill(s) through the system 10 to obtain master information and derive thresholds of acceptability from the bills, in any of the manners heretofore described. The operator may select which type of tests and/or sensor(s) that should be used to obtain the master information through a learn mode selection menu. For example, an operator may wish to use optical and magnetic sensors for U.S. currency and only optical sensors for Canadian currency. After the operator has obtained master information from each desired currency denomination and type, the operator instructs the system 10 to enter "standard" mode, or to depart the "learn" mode. The operator may nevertheless re-enter the learn mode at a subsequent time to obtain master information from other currency denominations, types and/or series.

It will be appreciated that the master information obtained in "learn" mode is not limited to ranges of values as described in the examples above. Rather, the master information may comprise pattern information, numerical thresholds other than ranges, or generally any type of information which may be obtained by the learn mode sensors.

The sensors used to obtain master information in learn mode (or, the "learn mode" sensors) may be either separate from or the same as the sensors used to obtain data in standard mode (or, the "standard mode" sensors). Where the sensors are the same in both learn mode and standard mode, the sensors constitute "dual-function" sensors (e.g., operable as both a "learn mode" sensor and a "standard mode" sensor).

Figure 3A:
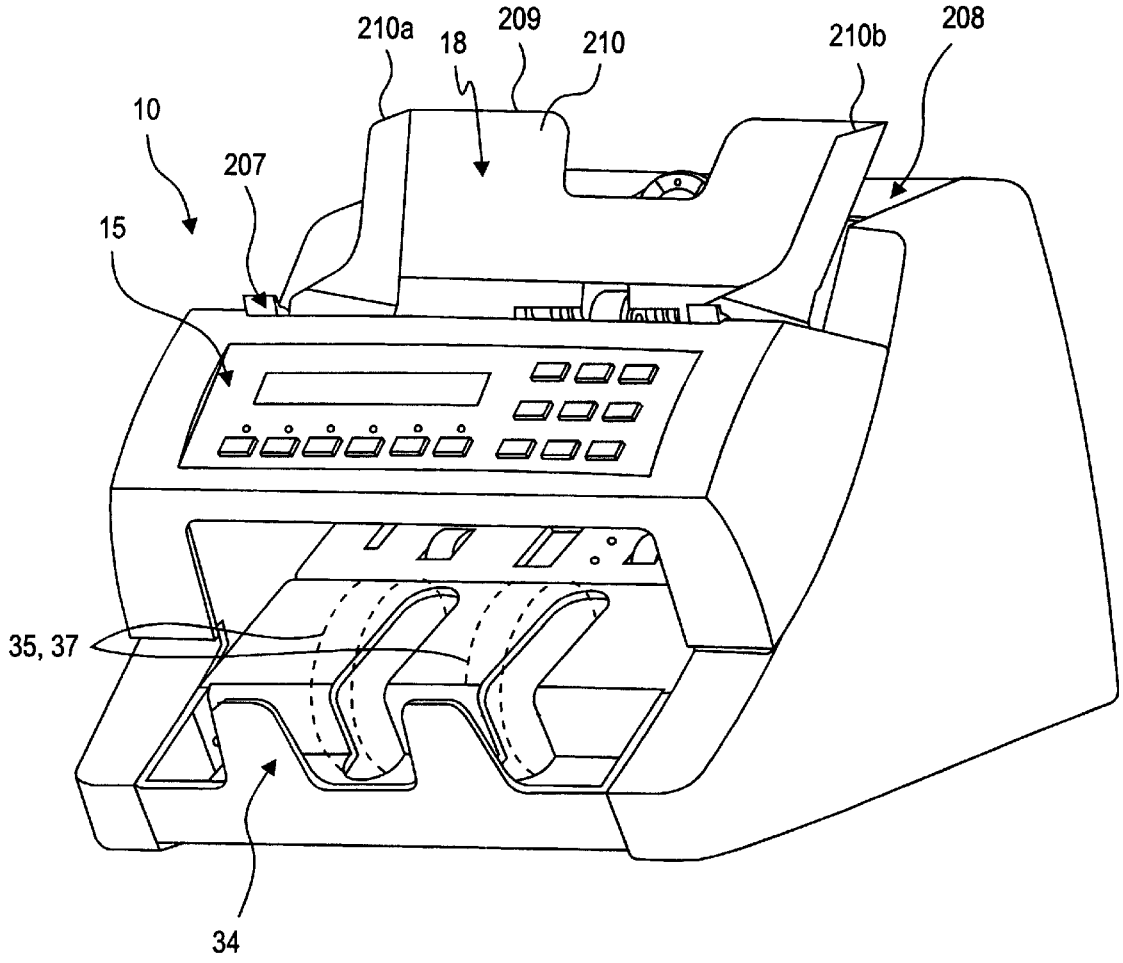
FIG. 3*a* is a perspective view of a single-pocket document handling system according to one embodiment of the present invention.
Figure 3B:
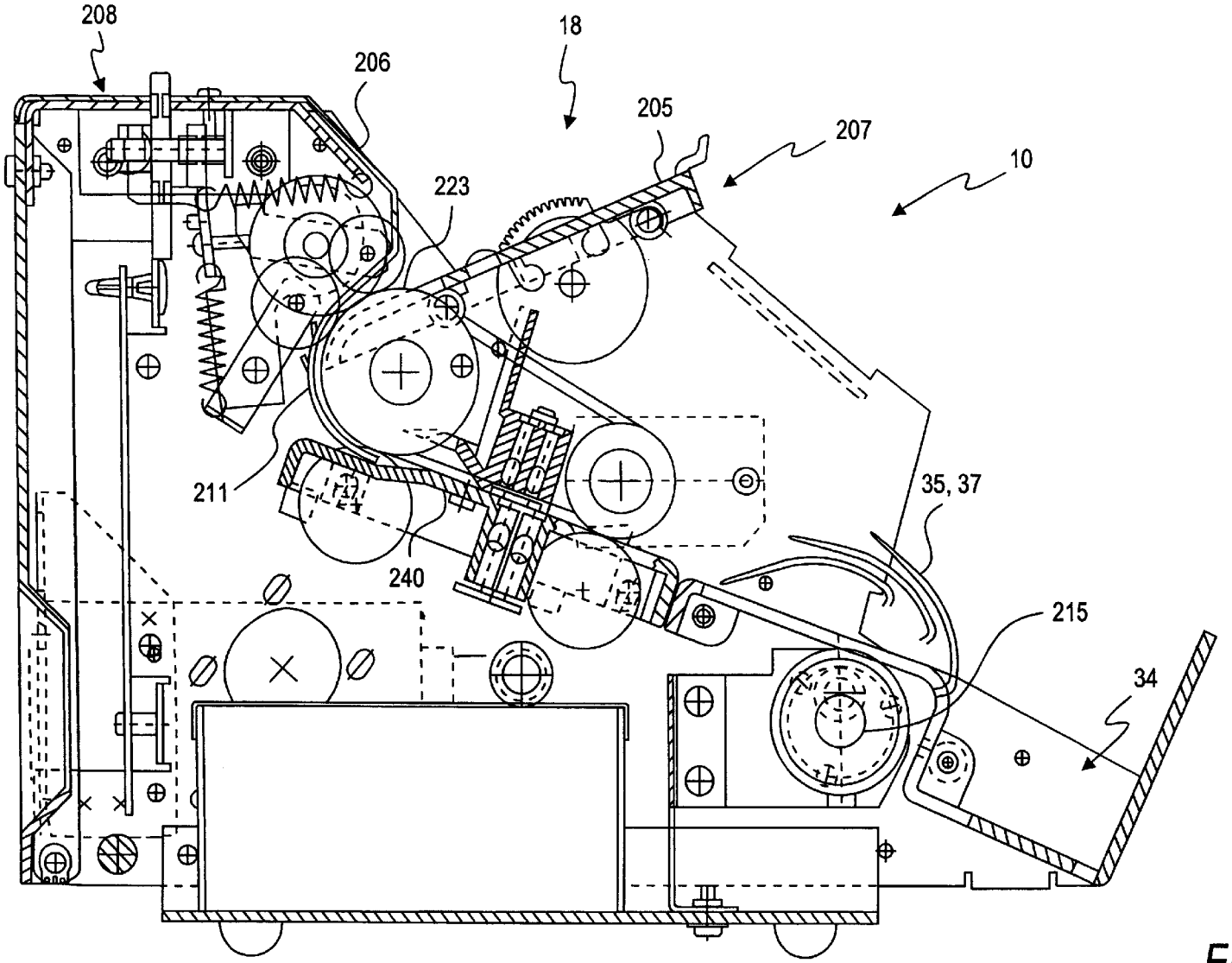
FIG. 3*b* is a side sectional view of the single-pocket document handling system of FIG. 3*a* depicting various transport rolls in side elevation.
Figure 4A:
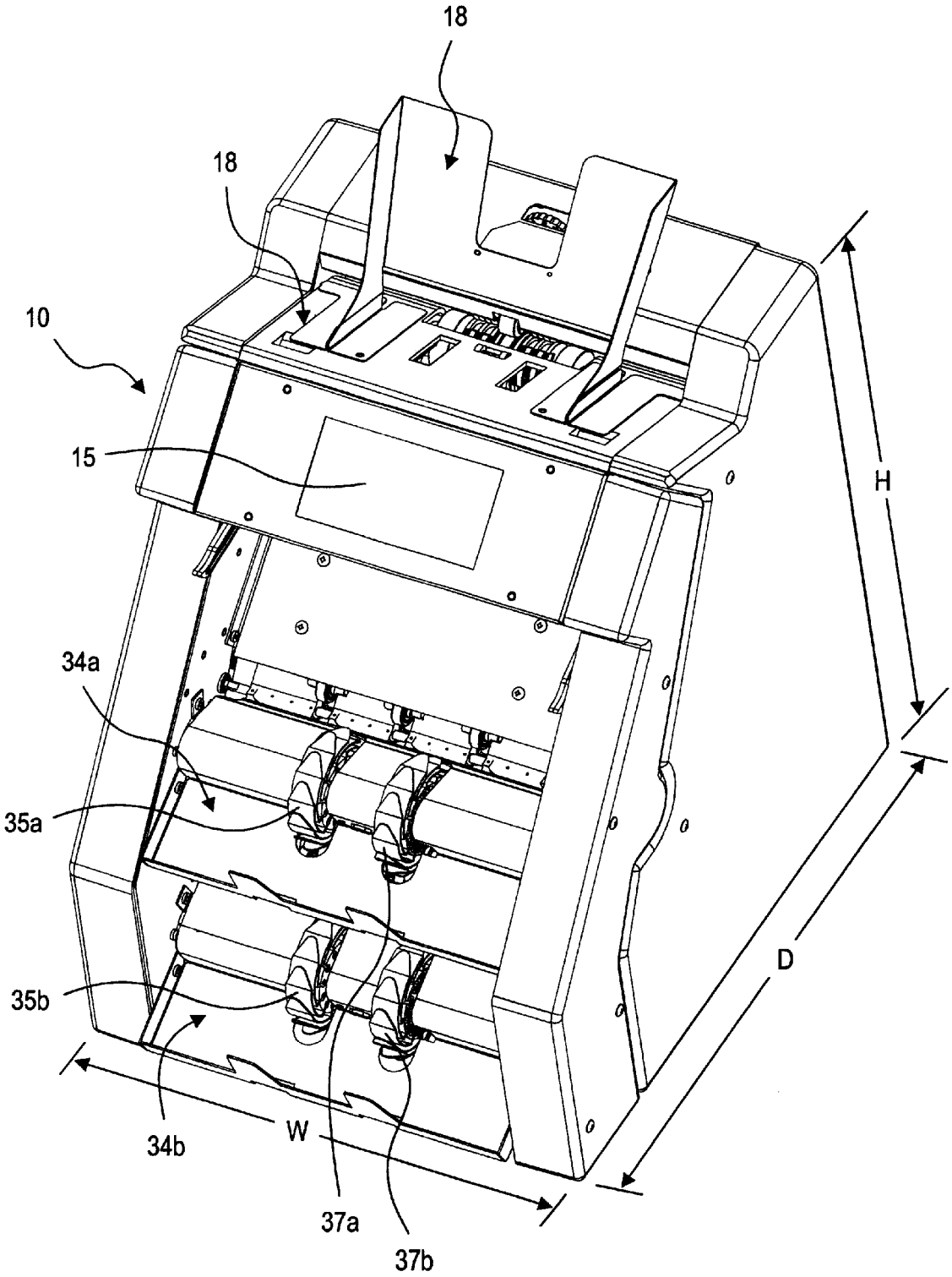
FIG. 4*a* is a perspective view of a two-pocket document handling system according to one embodiment of the present invention.
Figure 4B:
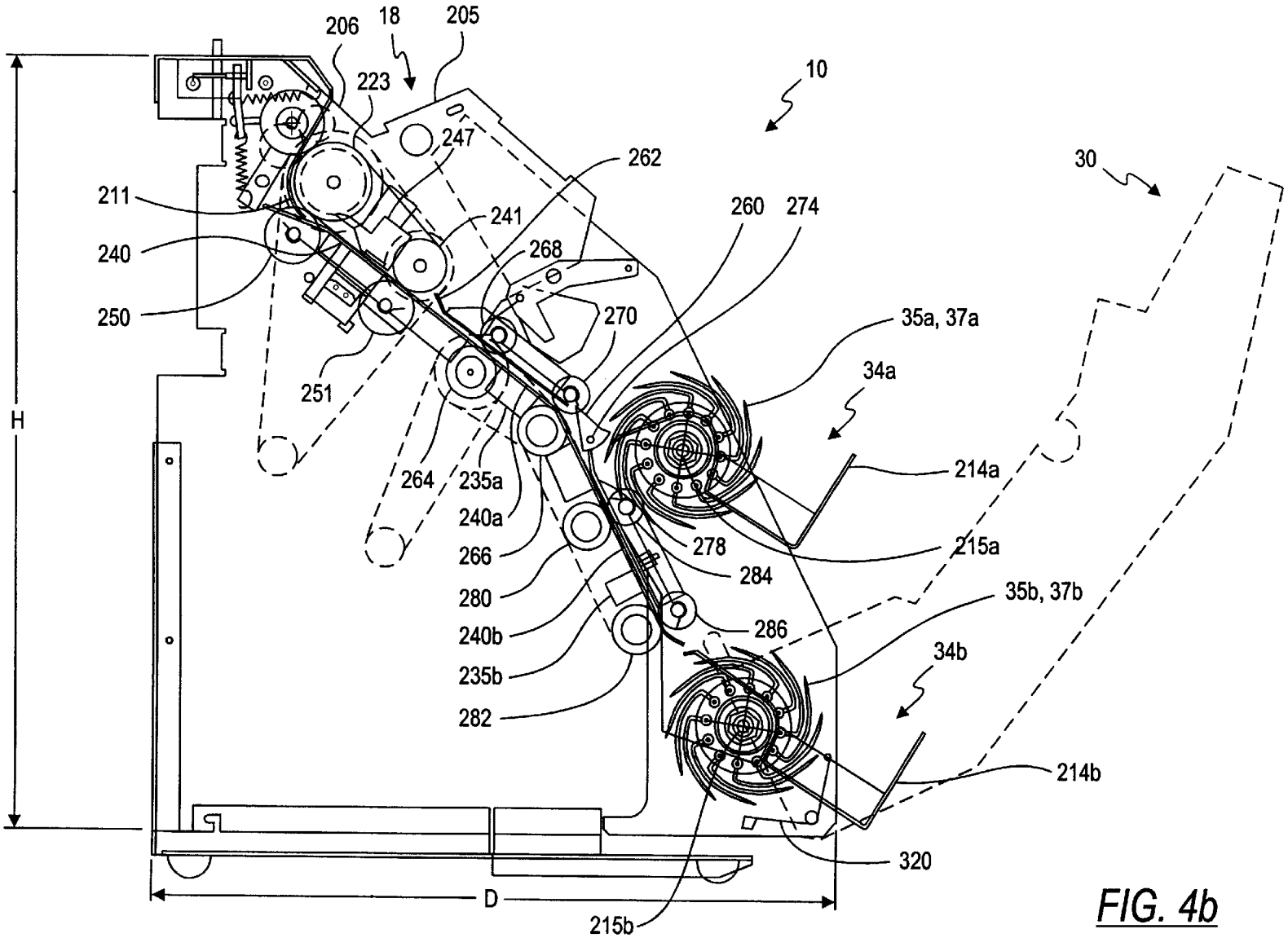
FIG. 4*b* is a side sectional view of the two-pocket document handling system of FIG. 4*a* depicting various transport rolls in side elevation.
Figure 5:
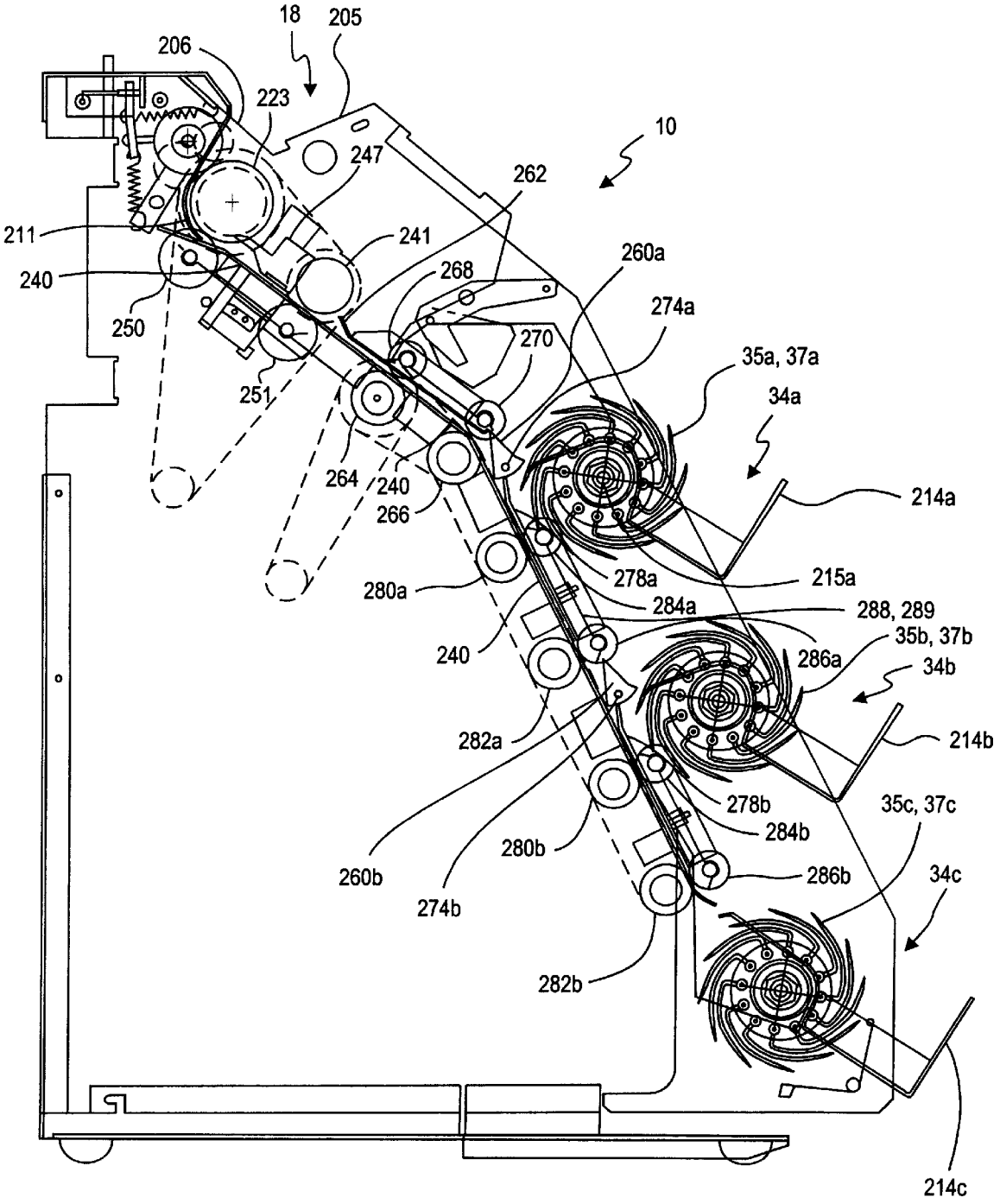
FIG. 5 is a side sectional view of a three-pocket document handling system depicting various transport rolls in side elevation.
Figure 6:
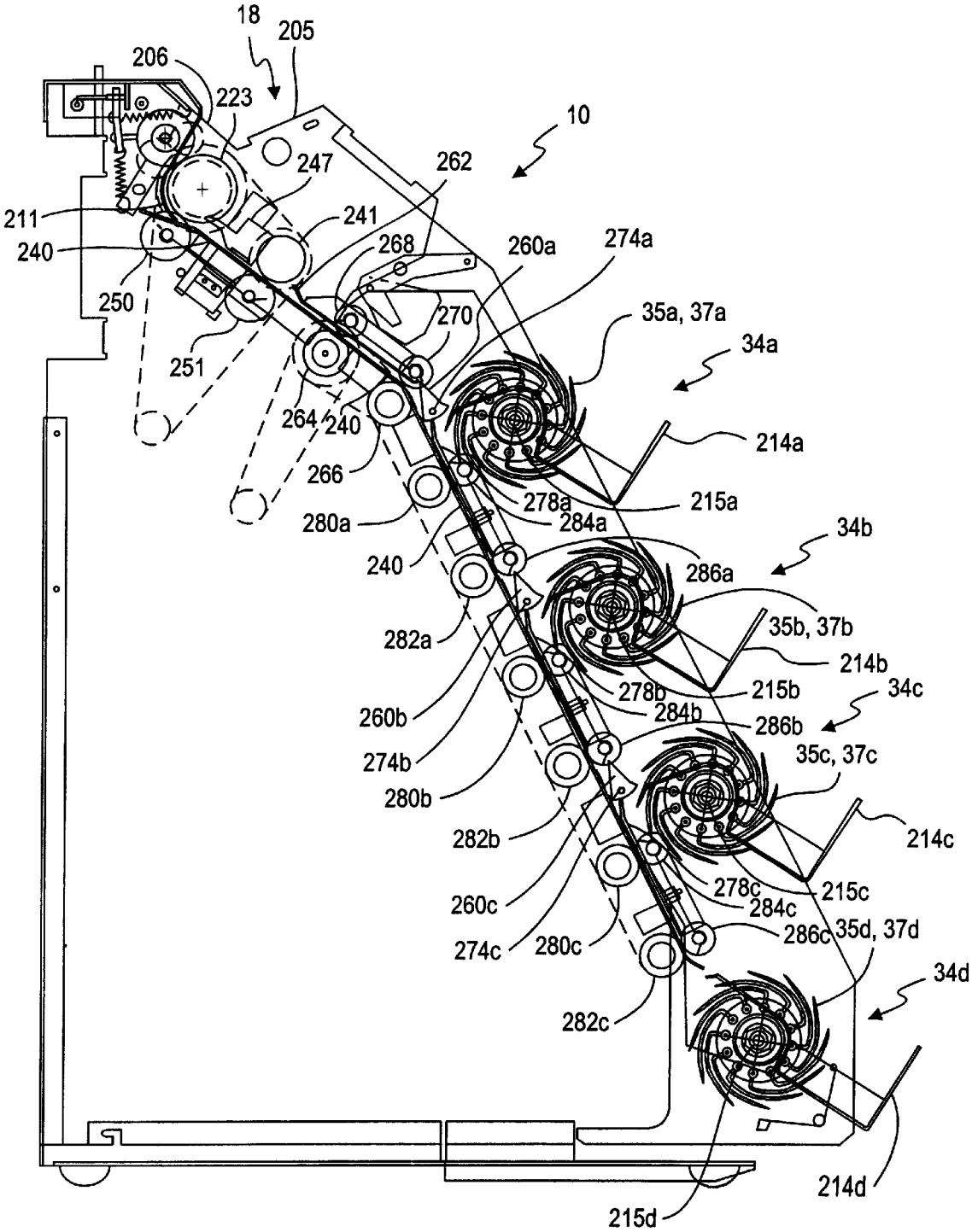
FIG. 6 is a side sectional view of a four-pocket document handling system depicting various transport rolls in side elevation.
Figure 7:
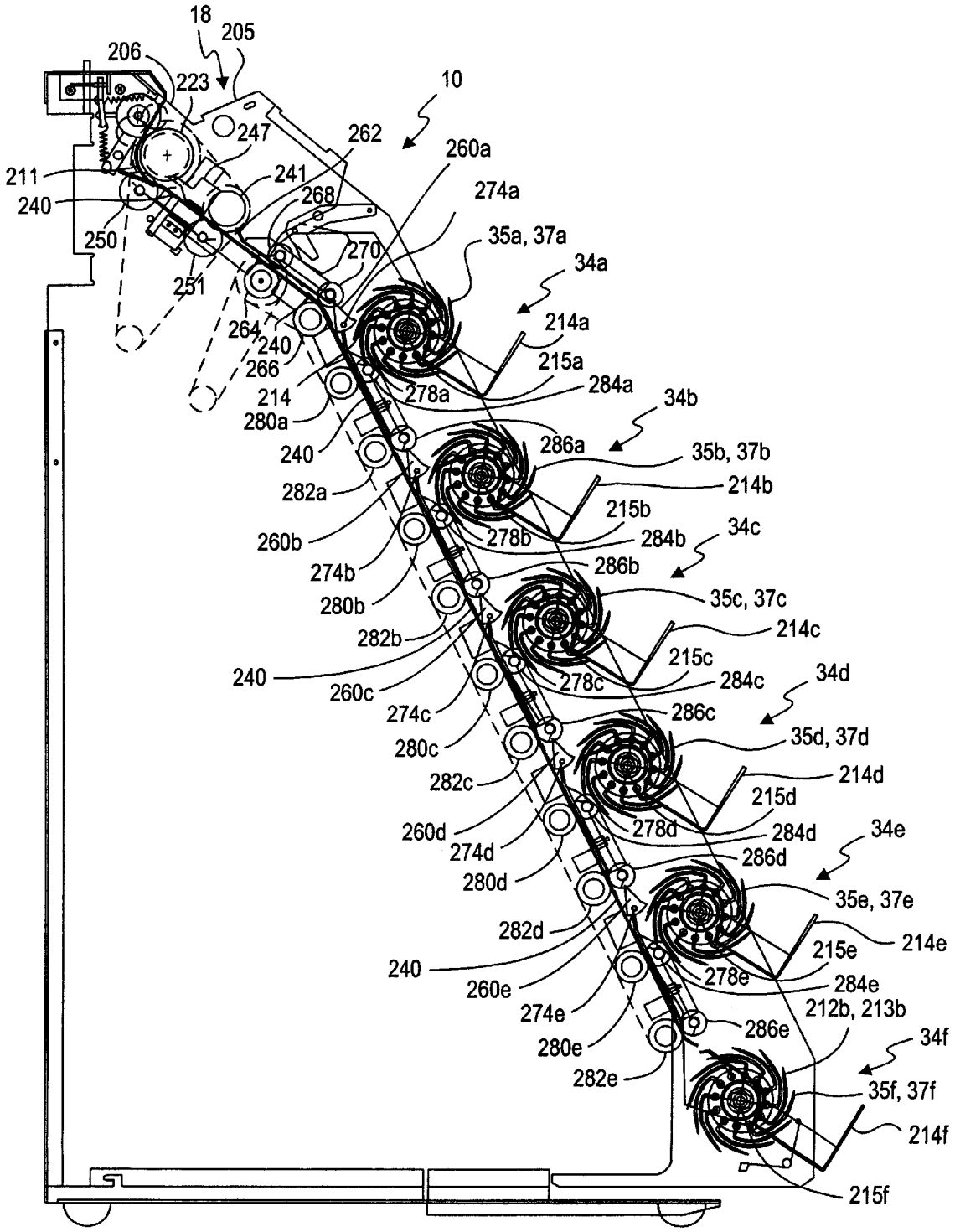
FIG. 7 is a side sectional view of a six-pocket document handling system depicting various transport rolls in side elevation.

In one embodiment, after evaluation of the bills by the document handling system 10, in learn mode and/or standard mode, each of the bills is transported to a stacker 34 which may include one or more "pockets" or output receptacles for receiving the bills. For example, FIGS. 3*a* and 3*b* portray an embodiment of the present invention in which the document handling system 10 includes a single-pocket stacker, whereas FIGS. 4*a* and 4*b* portray an embodiment of the present invention in which the document handling system 10 includes a two-pocket stacker. FIGS. 5, 6 and 7 portray other multi-pocket embodiments of the present invention in which the document handling system 10 includes a three-, four- and six-pocket stacker, respectively. The single-pocket embodiment shown in FIG. 3 is described in detail in U.S. patent application Ser. No. 08/800,053, filed Feb. 14, 1997 and entitled "Method and Apparatus for Document Identification and Authentication." The multi-pocket embodiments shown in FIGS. 4 through 7 are described in detail in U.S. patent application Ser. No. 08/916,100, filed Aug. 21, 1997 and entitled "Multi-Pocket Currency Discriminator". Both applications are assigned to the assignee of the present invention and incorporated herein by reference.

In some embodiments, the document handling systems 10 of the type shown in FIGS. 3 through 7 are compact and relatively lightweight, such that they may be rested upon a tabletop. One embodiment of the single-pocket document handling system 10 (FIGS. 3*a* and 3*b*), for example, has a height (H) of about 17½ inches, width (W) of about 13½ inches, and a depth (D) of about 15 inches. In this embodiment, therefore, the document handling system 10 has a "footprint" of 13½ inches by 15 inches, or about 202.5 square inches (somewhat less than 1½ square feet), which is sufficiently small to fit on a typical tabletop. The weight of the system 10 in this embodiment is about 40 pounds. With respect to U.S. currency (having dimensions of about 2½ inches by 6 inches), the height (H) of the document handling system is about three bill lengths, the width (W) is about 2 bill lengths and the depth (D) is about 2½ bill lengths, and the footprint of the document handling system is about 12 to 13½ times that of a U.S. bill.

Similarly, the multi-pocket systems (FIGS. 4–7), in some embodiments, may be constructed with generally the same "footprint," allowing them to be rested upon a typical tabletop. Generally, however, where the multi-pocket systems 10 are constructed with the same footprint as the single-pocket system, they will be taller and heavier than the single-pocket system, with the relative heights and weights of the respective systems 10 corresponding generally to the number of pockets. Thus, in general, where the multi-pocket systems have the same size "footprint," the six-pocket system 10 (FIG. 7) will be taller and heavier than the four-pocket system 10 (FIG. 6), which in turn will be taller and heavier than the three-pocket system 10 (FIG. 5) and the two-pocket system 10 (FIGS. 4*a* and 4*b*).

In either of the above systems, the currency bills are fed, one by one, from a stack of currency bills placed in the input receptacle (e.g. "hopper") 18 into a transport mechanism, which guides the currency bills across optical and/or magnetic sensors to the output receptacle(s) 34. In one embodiment, the document handling system 10 is capable of transporting, scanning, and determining the denomination and/or authenticity of the bills at a rate in excess of 800 to 1000 bills per minute.

The input receptacle 18 for receiving a stack of bills to be processed is formed by downwardly sloping and converging walls 205 and 206 formed by a pair of removable covers 207 and 208 (see FIG. 3*b*) which snap onto a frame. The rear wall 206 supports a removable hopper 209 which includes a rear wall 210 a pair of inwardly and downwardly slope side walls 210*a* and 210*b* which complete the receptacle for the stack of currency bills to be processed.

One embodiment of an input receptacle is described and illustrated in more detail in U.S. Pat. No. 5,687,963, entitled "Method and Apparatus for Discriminating and Counting Documents" which is incorporated by reference. The currency discriminator 10 has a display area 15 which may include physical keys or buttons (FIG. 3*a*) and a display window for displaying information associated with operation of the machine. Alternatively, the display area 15 may include other forms of displays and/or keypads such as a touch panel display.

From the input receptacle 18, the currency bills in each of the systems 10 (see FIGS. 3*b*, and 4*b* through 7) are moved in seriatim from the bottom of a stack of bills along a curved guideway 211, which receives bills moving downwardly and rearwardly and changes the direction of travel to a forward direction. The curvature of the guideway 211 corresponds substantially to the curved periphery of a drive roll 223 so as to form a narrow passageway for the bills along the rear side of the drive roll 223. An exit end of the curved guideway 211 directs the bills onto a transport plate 240 which carries the bills through an evaluation section and to the output receptacle(s) 34.

In the single-pocket embodiment (FIGS. 3*a* and 3*b*), stacking of the bills is accomplished by a pair of driven stacking wheels 35 and 37. The stacker wheels 35, 37 are supported for rotational movement about a shaft 215 journalled on a rigid frame and driven by a motor (not shown). Flexible blades of the stacker wheels 35 and 37 deliver the bills onto a forward end of the output receptacle 34.

In the two-pocket embodiment (FIGS. 4*a* and 4*b*), stacking of the bills is accomplished by a pair of driven stacking wheels 35*a* and 37*a* for the first or upper output receptacle 34*a* and by a pair of stacking wheels 35*b* and 37*b* for the second or bottom output receptacle 34*b*. The stacker wheels 35*a*,37*a* and 35*b*, 37*b* are supported for rotational movement about respective shafts 215*a,b* journalled on a rigid frame and driven by a motor (not shown). Flexible blades of the stacker wheels 35*a* and 37*a* deliver the bills onto a forward end of a stacker plate 214*a*. Similarly, the flexible blades of the stacker wheels 35*b* and 37*b* deliver the bills onto a forward end of a stacker plate 214*b*. A diverter 260 directs the bills to either the first or second output receptacle 34*a*, 34*b*. When the diverter is in a lower position, bills are directed to the first output receptacle 34*a*. When the diverter 260 is in an upper position, bills proceed in the direction of the second output receptacle 34*b*.

FIGS. 5 through 7 depict alternative forms of multi-pocket currency evaluation devices 10 which may be utilized in the present invention. FIG. 5 depicts a three-pocket currency evaluation device 10, FIG. 6 depicts a four-pocket currency evaluation device 10 and FIG. 7 depicts a six-pocket document evaluation device 10. The multi-pocket document evaluation devices 10 in FIGS. 5 through 7 have a transport mechanism which includes a transport plate or guide plate 240 for guiding currency bills to one of a plurality of output receptacles 34. The transport plate 240 according to one embodiment is substantially flat and linear without any protruding features. Before reaching the output receptacles 34, bill can be, for example, evaluated, analyzed, authenticated, discriminated, counted and/or otherwise processed.

The multi-pocket document evaluation devices 10 move the currency bills in seriatim from the bottom of a stack of bills along the curved guideway 211 which receives bills moving downwardly and rearwardly and changes the direction of travel to a forward direction. An exit end of the curved guideway 211 directs the bills onto the transport plate 240 which carries the bills through an evaluation section and to one of the output receptacles 34. A plurality of diverters 260 direct the bills to the output receptacles 34. When a diverter 260 is in its lower position, bills are directed to the corresponding output receptacle 217. When a diverter 260 is in its upper position, bills proceed in the direction of the remaining output receptacles. Similar parts which are repeated in the several embodiments for use with each of multiple stacker wheels 35, 37 and output receptacles 34, are designated by like reference numerals with suffixes a, b, c, etc., as are their corresponding stacker wheels and output receptacles.

The multi-pocket currency evaluation devices 10 of FIGS. 4*b* through 7 include passive rolls 250, 251 which are mounted on an underside of the transport plate 240 and are biased into counter-rotating contact with their corresponding driven upper rolls 223 and 241. These embodiments include a plurality of follower plates which are substantially free from surface features and are substantially smooth like the transport plate 240. The follower plates 262 and 278, which are positioned and spaced in relation to transport plate 240 so as to collectively define a currency transport pathway. In one embodiment, follower plates 262 and 278, have apertures only where necessary for accommodation of passive rolls 268, 270, 284, and 286.

The follower plate 262 works in conjunction with the upper portion of the transport plate 240 to guide a bill 20 from the passive roll 251 to a driven roll 264 and then to a driven roll 266. The passive rolls 268, 270 are biased by H-springs into counter-rotating contact with the corresponding driven rolls 264 and 266.

It will be appreciated that any of the stacker arrangements heretofore described may be utilized to receive currency bills, after they have been evaluated by the system 10, in either learn mode or standard mode. In one embodiment (not shown), however, bills transported through the system 10 in learn mode are not tranported from the input receptacle 18 to the output receptacle(s) 34, but rather are transported from the input receptacle 18 past the sensors, then in reverse manner are delivered back to the input receptacle 18.

It will further be appreciated that any of the multi-pocket machines may be constructed with wider bases defining generally larger "footprints" than those heretofore described. According to some embodiments, it is preferred, but not necessary, that such embodiments will still fit upon a typical tabletop. Generally, any embodiment of any of the multi-pocket machines having a larger footprint will be shorter in height than an embodiment having a smaller footprint. One embodiment of multi-pocket machine, for example, has a height of about 19½ inches, width of about 15½ inches, and a depth (D) of about 24½ inches, thus providing a "footprint" of about 380 square inches (about 2½ square feet), which is still sufficiently small to fit on a typical tabletop.

Figure 8:
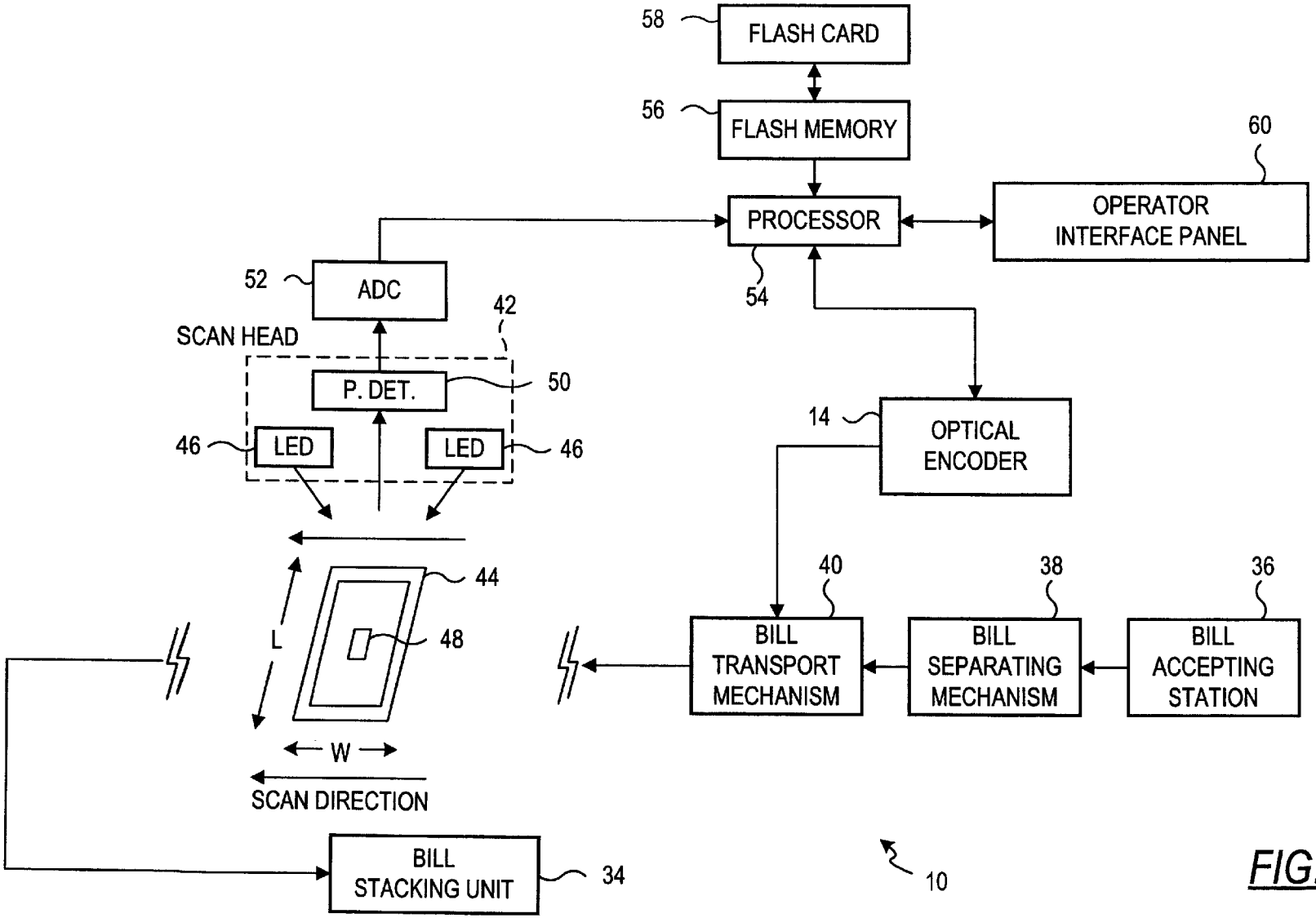
FIG. 8 is a functional block diagram illustrating one embodiment of the document handling system according to the present invention.

Now turning to FIG. 8, there is depicted a functional block diagram of a document handling system 10 embodying principles of the present invention. Currency bills to be evaluated (in "standard" mode) or from which master information will be generated (in "learn" mode) are positioned in a bill accepting station 36. Accepted bills are acted upon by a bill separating mechanism 38 which functions to pick out or separate one bill at a time for being sequentially relayed by a bill transport mechanism 40, according to a precisely predetermined transport path, across an optical scanhead 42. The optical scanhead 42 comprises at least one light source 46 directing a beam of coherent light downwardly onto the bill transport path so as to illuminate a substantially rectangular light strip 48 upon the currency bill 44 positioned on the transport path below the scanhead 42. Light reflected off the illuminated strip 48 is sensed by a photodetector 50 positioned directly above the strip. After passing across the optical scanhead 42, each of the bills is transported to a bill stacking unit 34 which may include a plurality of "pockets" or output receptacles for receiving the bills, as described above.

Alternatively or additionally, the document handling system 10 may include a magnetic scanhead or any other type of sensor known in the art.

The analog output of the photodetector 50 is converted into a digital signal by means of an analog-to-digital (ADC) converter unit 52 whose output is fed as a digital input to a controller or processor 54, such as a central processing unit (CPU), a microprocessor, or the like. An encoder 14 provides an input to the processor to determine the timing of the operations of the document handling system 10, and a resident memory, here shown as a flash memory 56 is provided for storing software codes and/or data related to operation of the document handling system 10. A flash card 58 having its own flash memory (not shown) may be electrically connected to the flash memory 56 to provide updates or to copy from the flash memory 56, as will be described in detail hereinafter.

An operator interface panel 60 provides an operator the capability of sending input data to, or receiving output data from, the document handling system 10. Input data may comprise, for example, user-selected operating modes and user-defined operating parameters for the document handling system 10. Output data may comprise, for example, a display of the operating modes and/or status of the document handling system 10 and the number or cumulative values of evaluated bills. In one embodiment, the operator interface panel 60 comprises a touch-screen "keypad" and display which may be used to provide input data and display output data related to operation of the document handling system 10. In one embodiment, the operator may customize the touch-screen keypad to define names or labels associated with particular keys or displays, delete keys, reposition keys or modify the complexity of the operator interface panel 60 to match the level of operator experience. The user-tailored operating parameters are encoded in the control software executed by the processor and stored in the flash memory 56.

In the "standard" mode of operation, whatever type(s) of sensor(s) are employed, the sensor output(s) comprise test data representing selected attributes (e.g., optical pattern, size, etc.) of bill(s) under test. The test data is compared by the processor to master information associated with the selected attributes to determine the denomination or authenticity of the bills, which may be based on various sensitivity levels, as described above. More than one attribute or type of sensing may be used to evaluate a given bill. For example, in an embodiment utilizing size detection to provide an initial determination of authenticity of a bill, characteristic data associated with attributes other than size may be used to subsequently evaluate the note, and the initial size determination may be used at least in part to select master information for comparison with data gathered from a test bill.

The master information used in evaluating bills under test is stored in the flash memory 56. Upon connection of the flash card 58 to the flash memory 56, the contents of the flash memory, including the master information generated in the "learn" mode, are copied onto the flash card 58. Thereafter, the flash card 58 may be used to update the flash memories of additional machines. In this system, therefore, the independent generation of master information accomplished in the "learn" mode need only be accomplished by one machine and quickly and efficiently loaded into other machines without repeating the "learn" mode in the other machines.

Flash memories are relatively well known in the art. Some of the several advantages of flash memories are that they are nonvolatile (e.g. their data content is preserved without requiring connection to a power supply) and they may be electrically erased and reprogrammed within fractions of a second through electrical control signals. An example of a specific type of flash memory which may be used in the document handling system 10 is product number Am29F010, commercially available from Advanced Micro Devices, Inc. ("AMD") of Sunnyvale, Calif. and described in detail in AMD's publication entitled "Flash Memory Products—1996 Data Book/Handbook", incorporated herein by reference. However, those skilled in the art will appreciate that other types of flash memories may be utilized, depending on the system memory requirements and desired operating characteristics.

Figure 9A:
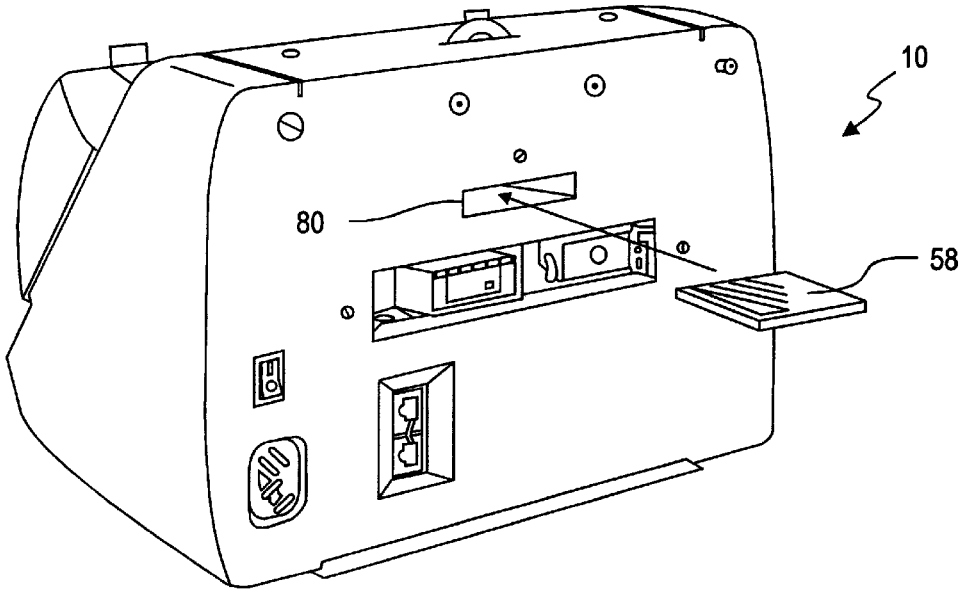
FIGS. 9*a* and 9*b* are isometric views depicting the insertion of a flash card into a document handling machine according to one embodiment of the present invention.

FIG. 9*a* depicts a document handling machine 10 having an external slot 80 for receiving a flash card according to one embodiment of the invention. A removable flash card 58 is adapted to be inserted by a user through the external slot 80 and into a mating socket 84 located inside the machine behind the slot 80. Upon insertion of the flash card 58 into the socket 84, an electrical connection is formed between the flash card 58 and a flash memory 56 resident in the machine. According to one embodiment, the flash card 58 is small and lightweight, sturdy enough to withstand multiple uses, and adapted to be easily insertable into the slot 80 and corresponding socket 84 of the document handling machine 10 by users not having any special training. Further, the flash card 58 should not require any special electrostatic or physical protection to protect it from damage during shipping and handling. One type of flash card that has been found to satisfy these criteria is the FlashLite™ Memory Card available from AMP, Inc. of Harrisburg, Pa. However, it is envisioned that other suitable types of flash cards will become available from other manufacturers. The FlashLite™ card has a thickness of 3.3 mm (⅛ inch), a width of approximately 45 mm (1.8 inches) and a 68-pin connector interface compatible with the Personal Computer Memory Card International Association (PCMCIA) industry standards. Its length may be varied to suit the needs of the user. In one embodiment, two sizes of flashcards (designated "half size" and "full size") have lengths of 2.1 inches (53 mm) and 3.3 inches (84 mm), respectively, but other sizes of flash cards may also be utilized.

Figure 9B:
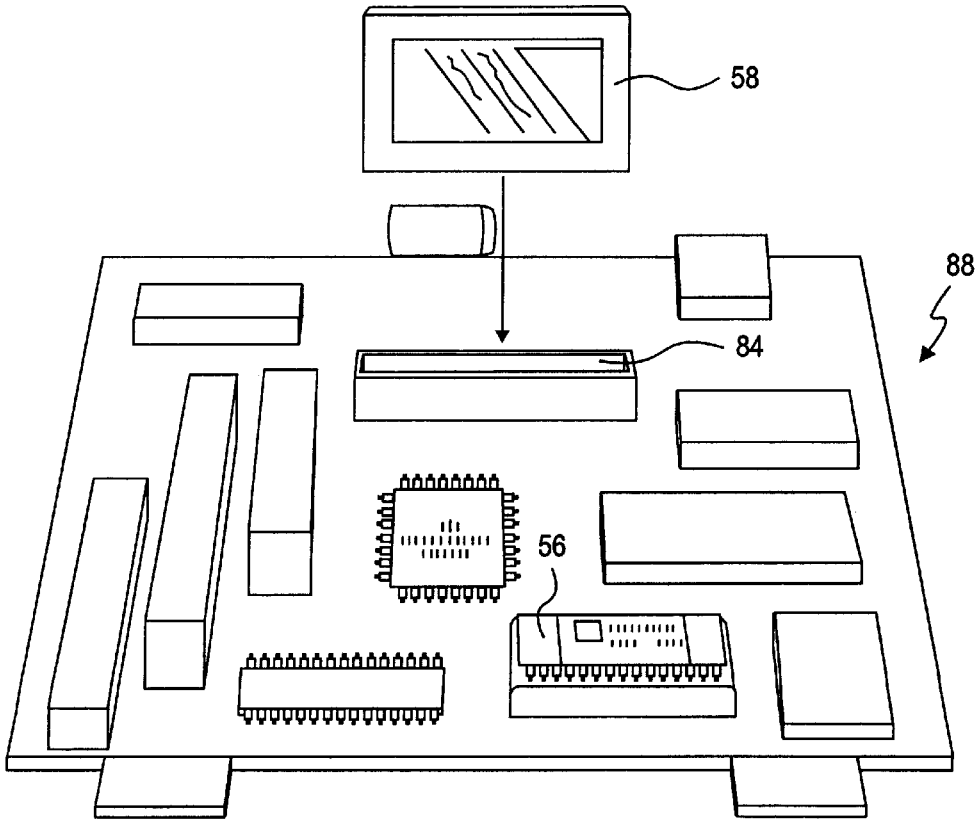

FIG. 9*b* depicts a circuit board assembly 88 including a socket 84 adapted to receive the flash card 58 according to one embodiment of the invention. As will be appreciated by those skilled in the art, however, the flash card 58 may be electrically coupled to the resident memory by any of several alternative means other than a socket. Upon insertion of the flash card 58 into the socket 84, electrical signals are communicated from the flash card 58 to the resident flash memory 56 of the machine. In one embodiment, the socket 84 comprises a PCMCIA-compatible 68-position receptacle for receiving a flash card such as the FlashLite™ card described above. One type of socket that may be used for this purpose is AMP, Inc. product number 146773-1, which is adapted to extend vertically from the circuit board assembly 88 within the document handling machine 10. However, it will be appreciated by those skilled in the art that other types of sockets may be utilized, including those positioned horizontally in relation to the circuit board assembly 88, or those including a lever or button which may be depressed to eject the flash card 58 from the socket 84.

Upon insertion of the flash card 58 into its socket 84, the processor (FIG. 8) is capable of electrically detecting the presence of the card. If the FlashLite™ card is used, this is accomplished by means of two specially designated connector pins $CD_1$ and $CD_2$ (assigned to pin numbers 36 and 67, respectively) being shorted to ground. The CPU then compares the contents of the flash card memory with the contents of the resident flash memory 56. If the contents of the memories are different, the required sectors in the flash card memory are erased and replaced with new code copied from the resident flash memory 56. If the contents of the memories are the same, an audible or visual message is provided to the user indicating that the process is concluded. Upon successful completion of the memory transfer, the flash card memory thereby is programmed with the same set of master information as the resident flash memory. Thus, for example, where the resident flash memory contains master information obtained in "learn mode" from a family of different currency types and denominations, such master information becomes transferred to the flash card memory.

The flash card 58 can thereafter be removed from the document handling machine 10 and plugged into any other document handling machine requiring that same set of master information to denominate and/or authenticate currency bills. The master information is copied from the flash card memory to the flash memory of the additional machines in substantially the same manner (although reversed) as they were initially copied onto the flash card. Thus, for example, where the flash card memory contains master information obtained in "learn mode" from a document handling machine 10 which has been transferred to the flash card, such master information can be transferred to the resident flash memory of a number of other machines. The transfer of memory in this manner may thereby be used to replace or upgrade the denominations and/or types currencies to be processed by any particular machine. In the event of an unsuccessful memory transfer, the machine will automatically re-attempt the transfer until, after multiple unsuccessful attempts, the user will be advised that there is a hard system failure and to call for service.

For purposes of illustration, suppose for example that a particular machine 10 includes master information to accommodate German DMs and EC currency, and it is desired for whatever reason to replace this "first" set of master information with a "second" set of master information, to accommodate British pounds and U.S. Dollars. This may be accomplished by simply plugging an appropriately-programmed flash card into the machine 10, causing the first set of master information to be replaced with the second set. It will be appreciated that the memory of any particular machine 10 may be changed multiple times, to accommodate any of several alternative combinations of currencies through the above-described flash card memory transfer.

It has been found that the light source and/or sensor of a particular machine may degrade over time. Additionally, the light source and/or sensor of any particular machine may be affected by dust, temperature, imperfections, scratches, or anything that may affect the brightness of the bulb or sensitivity of the sensor. Similarly, machines utilizing magnetic sensors will also generally degrade over time and/or be affected by its physical environment including dust, temperature, etc. When multiple machines are employed, as in the above-described system using flash cards to pass threshold data between multiple machines, each machine will typically have a measurement "bias" unique to that machine caused by the state of degradation of the optical or magnetic sensors associated with each individual machine. Due to the measurement biases between machines, master information generated by one machine will not directly correspond to such values in another machine. Consequently, if the measurement biases are not corrected, evaluation of bills will be inconsistent from machine to machine.

The present invention is designed to achieve a substantially consistent evaluation of bills between machines by "normalizing" the master information and test data to account for differences in sensors between machines. For example, where the master information and test data comprise numerical values, this is accomplished by dividing the threshold data and test data obtained from each machine by a reference value corresponding to the measurement of a common reference by each respective machine. The common reference may comprise, for example, an object such as a mirror or piece of paper or plastic that is present in each machine. The reference value is obtained in each respective machine by scanning the common reference with respect to a selected attribute such as size, density pattern, etc. The master information and/or test data obtained from each individual machine is then divided by the appropriate reference value to define normalized master information and/or test data corresponding to each machine. The evaluation of bills in standard mode may thereafter be accomplished by comparing the normalized test data to normalized master information.

The normalized master information may be obtained from one or more machines in "learn" mode and transferred to other machines by using the flash card process heretofore described. By using normalized master information to evaluate bills, a consistent evaluation of bills is achieved from machine to machine even though the sensors in each machine may be in different states of degradation. For example, suppose a first machine is operated in "learn" mode to derive master information, in the form of numerical threshold values, associated with optical sensing of a currency bill, and the threshold values are copied from the first machine to a second machine using the flash card process heretofore described. In actual terms, the threshold values derived by the first machine may comprise, for example, an upper limit of 2.0 volts and a lower limit of 1.0 volts. Suppose further that the first machine optically senses a reference object such as a piece of plastic and produces a reference value of 4.0 volts. The upper and lower threshold values are normalized by dividing them by the reference value, resulting in a normalized upper threshold of 0.5 and a normalized lower threshold of 0.25.

The normalized threshold values obtained from the first machine may then be transferred to a second machine including a reference object which is identical to or otherwise has the same measurable characteristics as the reference object in the first machine. Typically, the sensors in the second machine will be in a different state of degradation than the sensors in the first machine. For example, optical sensing of the reference object which produced a signal of 4.0 volts in the first machine may produce a signal of only 3.0 volts in the second machine. The second machine may nevertheless evaluate bills consistently with the first machine by comparing the normalized threshold values obtained from the first machine to normalized test data values obtained from the second machine. Alternatively, a consistent evaluation may be obtained by converting the normalized threshold values obtained from the first machine to "actual" (e.g., unnormalized) thresholds associated with the second machine and then comparing them to unnormalized test data obtained from the second machine.

For example, in the second machine described above, the normalized upper and lower thresholds obtained from the first machine (e.g., 0.5 and 0.25) may be converted to "actual" (e.g., unnormalized) thresholds appropriate to the second machine by multiplying the normalized values by the reference value (3.0 volts) obtained by the second machine. This results in an "actual" upper limit of 1.5 volts and an "actual" lower limit of 0.75 volts for the second machine. Evaluation of bills in standard mode may thereby be accomplished in the second machine by comparing "actual" data values of the bills under test to the "actual" threshold data derived from the normalized threshold data. Alternatively, the measured "actual" data values of the bills under test may be converted to normalized data values for comparison to the normalized threshold values.

Although the flash card loading system according to the present invention has heretofore been described in relation to the copying of master information, such as numerical threshold values, from machine to machine, it will be appreciated that the above described flash card loading system may be utilized to copy substantially all of the contents of the flash memory from one machine to the flash memory of other machines. In addition to master information, the contents of the flash memory may include, for example, tailored operating parameters associated with the particular document handling machine 10 such as, for example, a user-defined keyboard and/or display which have been programmed to suit an individual operator or particular machine. By using the flash card loading system described above, these tailored operating parameters may be quickly and efficiently transferred from one machine to a second machine, thereby customizing the operating parameters of the second machine to match the operating parameters of the first machine.

According to another embodiment of the present invention, the operator or end user of the document handling machine is provided with the ability to send control signals to the machine. The control signals may comprise, for example, signals for selecting learn mode or standard mode, as well as an override signal causing the machine not to use master information generated internally through the "learn" mode. The override signal may permit alternate master information to be sent to the machine to be used in place of the self-generated master information.

The control signals may further include an attribute-selection signal for selecting the attributes of the bills for which master information will be obtained. For example, in a document handling machine including both optical and magnetic sensors capable of measuring a variety of attributes, an operator may choose to use the attribute-selection signal to cause the document handling machine to measure only a particular attribute or sub-combination of attributes. The control signals may also include an authentication mode selection signal for selecting which items of master information will be used in authentication of subsequent currency bills. For example, if master information corresponding to both size and density have been obtained, an operator may use the authentication mode selection signal to use only master information based on size to authenticate subsequent bills. Preferably, each of the above signals are separately definable for separate denominations of bills.

Figure 10:
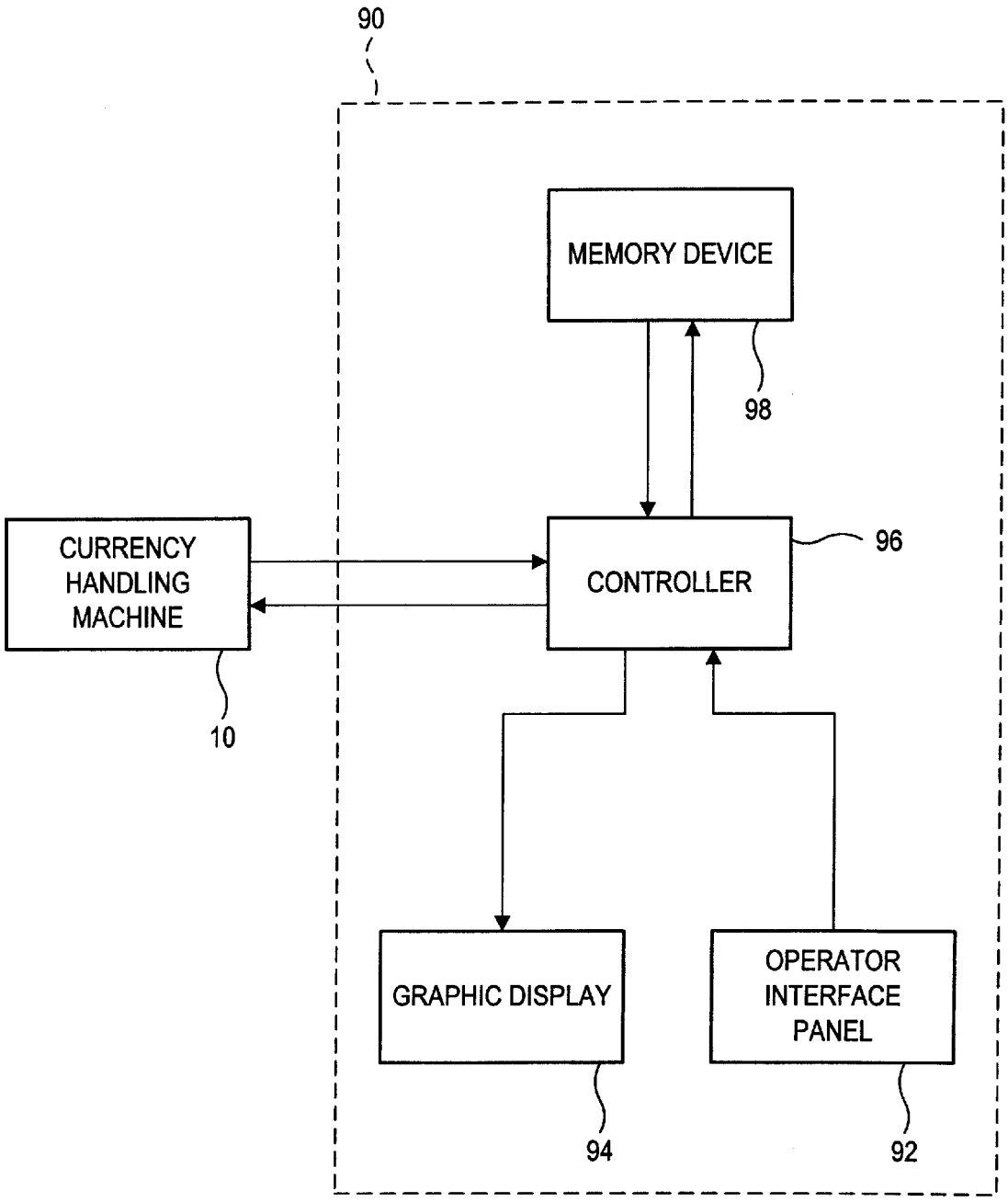
FIG. 10 is a block diagram showing the connection of a document handling machine to a cash settlement machine according to one embodiment of the present invention.

FIG. 10 depicts one embodiment of the present invention in which the aforementioned control signals are sent to the document handling machine 10 through a cash settlement machine 90. The cash settlement machine 90 is generally used to gather and record data relating to monetary transactions. For example, the operator of the cash settlement machine 90 may be a supervisor who is interested in the value of transactions performed by subordinates interacting with consumers at a transaction station. The cash settlement machine 90 records various financial data such as cash, coins, credit card receipts, coupons and other related data from each station. The data can be input into the cash settlement machine 90 manually or automatically via numerous peripheral machines such as the document handling machine 10.

In the cash settlement machine 90, an operator interface panel 92 provides for operator interaction with the cash settlement machine 90. Typically, the operator interface panel 92 is a conventional mechanical keyboard with depressable keys. Alternatively, the cash settlement machine 90 may receive inputs from the operator through a touchscreen. Such a configuration is described in U.S. patent application Ser. No. 08/467,585, filed Jun. 6, 1995 entitled "Cash Settlement Machine" which is commonly owned and is herein incorporated by reference. The keyboard and/or the touchscreen are used to enter data, or to instruct the cash settlement machine 90 to perform a function such as data manipulation or communication with a peripheral device. A graphics display monitor 94 displays numerous data for the operator including the status of the cash settlement machine 90, the information that is being manipulated, the operability of a peripheral device, etc.

Additionally, the controller 96 of the cash settlement machine 90 may record data to or retrieve data from a memory device 98. The memory device 98 contains numerous registers for storing blocks of information. For example, each register may be associated with a cash settlement transaction or a particular worker and is labeled accordingly by the operator. The memory device 98 can be external or internal to the cash settlement machine 90, but generally it is internal. The memory device 98 also contains the software which the controller 96 operates to perform desired functions, including software used to communicate with the peripheral devices such as the document handling system 10.

The types of data sent between the cash settlement machine 90 and the document handling machine 10 may comprise for example, the number of notes counted or the value of the notes scanned. However, as described briefly above, the cash settlement machine 90 may also be used to remotely alter the operating characteristics of the document handling system 10 through the use of control signals.

The remote altering of the sensitivity and density levels is especially useful when the operator of the cash settlement machine 90 is remotely located from the document handling system 10 (in another room or a different building). The cash settlement machine 90 is also useful when the document handling machine 10 comprises a prior art counter which only counts notes and has no means for determining denomination. In this situation, the operator of the cash settlement machine 90 knows that a certain denomination will be processed at the counter and so instructs the cash settlement machine 90. The cash settlement machine 90, upon receiving this instruction from the operator, sends a signal to the counter indicating the denomination that is to be processed. The counter then generates (in "learn" mode) or selects (in "standard" mode) the master information corresponding to the denomination to be processed. For example, the operator may enter at the host system that $20 notes will be processed. The host then relays to the counter that $20 notes will be counted. In learn mode, the counter then evaluates the representative set of $20 notes and generates a set of master information corresponding to the $20 notes. In standard mode, the counter evaluates the $20 notes with respect to the master information appropriate to $20 notes.

In the situation in which the document handling system 10 comprises a denomination discriminator or enhanced counter, the operator does not need to enter the value of the notes to be evaluated. The operator may nevertheless still desire to send control signals, such as the override signal, attribute-selection signal or authentication mode selection signal to the document handling system 10 as well as receive information from the document handling system 10.

To accomplish the above-identified communication functions, the document handling machine 10 must have the ability to react to signals received from the cash settlement machine 90. Therefore, in one embodiment, the document handling machine 10 has an electrical port to which a communications cable (attached to the host system) is connected. The electrical port is coupled to the controller of the document handling machine 10. Use of an established communications protocol allows the document handling machine 10 to detect multiple signals from the cash settlement machine 90, differentiate between the signals, and perform the function associated with a given signal. Additionally, the protocol also may permit the sending of a counterfeit detection signal to the cash settlement machine 90 when the document handling machine 10 processes a note that falls outside the proper threshold levels. These signals are sent via the electrical port and the communications cable.

Figure 11:
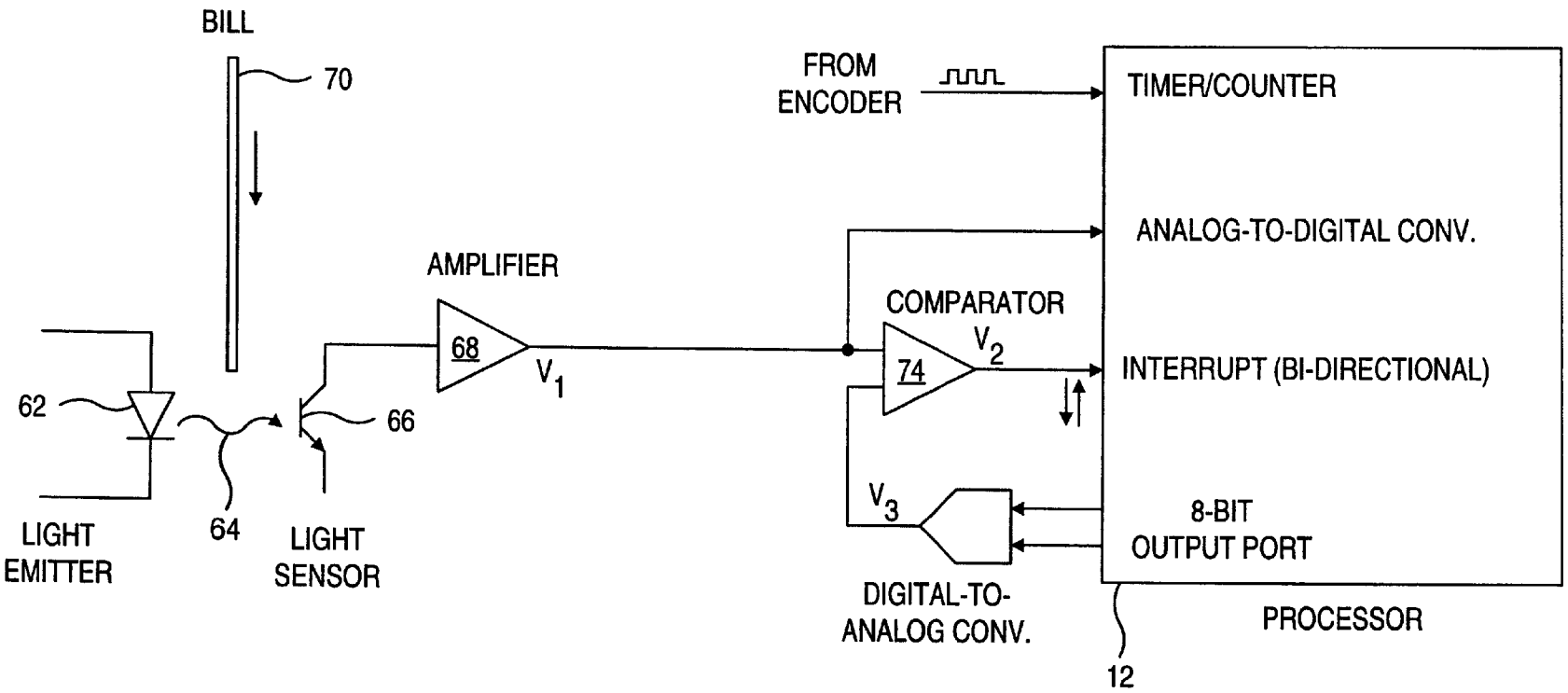
FIG. 11 is a block diagram of a digital size detection system which may be used in the document handling system of FIG. 8.

FIG. 11 illustrates an optical sensing system which may be used according to one embodiment of the present invention to detect the size of a currency bill under test. The authentication or discrimination of currency based on size is particularly useful in foreign markets in which the size of individual bills varies with their denomination. The size detection method includes a light emitter 62 adapted to send a light signal 64 toward a light sensor 66. The sensor 66 produces a signal which is amplified by amplifier 68 to produce a signal $V_1$ proportional to the amount of light passing between the emitter and sensor. A currency bill 70 is advanced across the optical path between the light emitter 62 and light sensor 66, causing a variation in the intensity of light received by the sensor 66. As will be appreciated, the bill 70 may be advanced across the optical path along its longer dimension or narrow dimension, respectively, depending on whether it is desired to measure the length or width of the bill.

At time $t_1$, before the bill 70 has begun to cross the path between the light emitter 62 and sensor 66, the amplified sensor signal $V_1$ is proportional to the maximum intensity of light received by the sensor 66. The maximum $V_1$ signal is digitized by an analog-to-digital converter and provided to the processor 12, which divides it by two to define a $V_3$ signal, equal to one-half of the maximum value of $V_1$, as a reference to a comparator 74. The other input to the comparator 74 is provided by the amplified sensor signal $V_1$ which represents the varying intensity of light received by the sensor 66 as the bill 70 crosses the path between the emitter 62 and sensor 66. In the comparator 74, the varying sensor signal $V_1$ is compared to the $V_3$ reference, and an output signal is provided to an interrupt device whenever the varying sensor signal $V_1$ falls above or below the $V_3$ reference.

Figure 12:
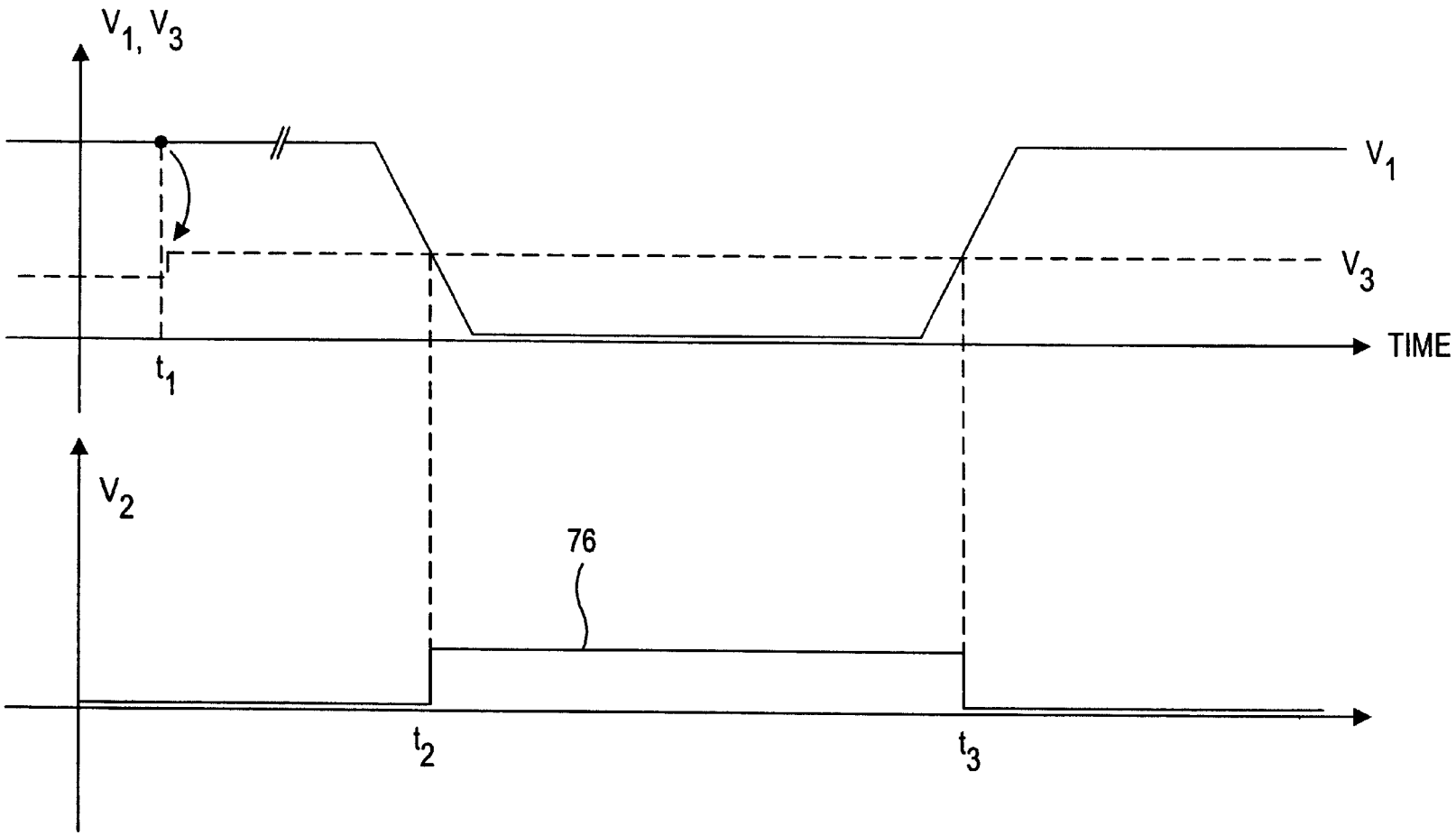
FIG. 12 is a timing diagram illustrating the operation of the size detection system of FIG. 11.

As can be seen more clearly in FIG. 12, the interrupt device thereafter produces a pulse 76 beginning at time $t_2$ (when the varying sensor signal $V_1$ falls below the $V_3$ reference) and ending at time $t_3$ (when the varying sensor signal $V_1$ rises above the $V_3$ reference). The length of the pulse 76 occurring between time $t_2$ and $t_3$ is computed by the processor 12 with reference to a series of timer pulses from the encoder 14 (e.g., FIG. 1 or FIG. 8). More specifically, at time $t_2$, the processor 12 begins to count the number of timer pulses received from the encoder and at time $t_3$ the microprocessor stops counting. The number of encoder pulses counted during the interval from time $t_2$ to time $t_3$ thereby represents the width of the bill 70 (if fed along its narrow dimension) or length of the bill 70 (if fed along its longer dimension).

It has been found that light intensity and/or sensor sensitivity will typically degrade throughout the life of the light emitter 62 and light sensor 66, causing the amplified sensor signal $V_1$ to become attenuated over time. The $V_1$ signal can be further attenuated by dust accumulation on the emitter or sensor. One of the advantages of the above-described size detection method is that it is independent of such variations in light intensity or sensor sensitivity. This is because the comparator reference $V_3$ is not a fixed value, but rather is logically related to the maximum value of $V_1$. When the maximum value of $V_1$ attenuates due to degradation of the light source, dust accumulation, etc., $V_3$ is correspondingly attenuated because its value is always equal to one-half of the maximum value of $V_1$. Consequently, the width of the pulse derived from the comparator output with respect to a fixed length bill will remain consistent throughout the life of the machine, independent of the degradation of the light source 62 and sensor 66.

Figure 13:
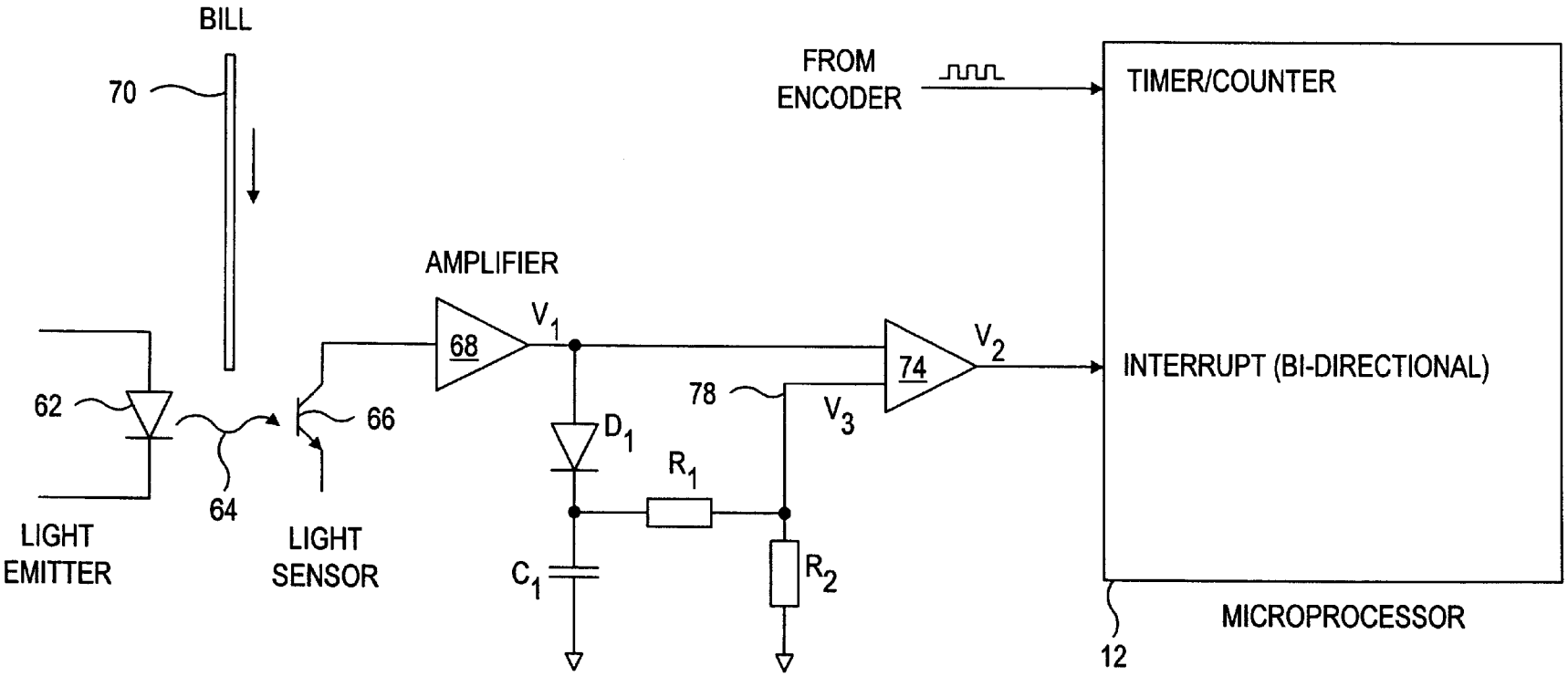
FIG. 13 is a block diagram of an analog size detection system which may be used in the document handling system of FIG. 8.

FIG. 13 portrays an alternative circuit which may be used to detect the size of a currency bill under test. In FIG. 13, the method of size detection is substantially similar to that described in relation to FIG. 11 except that it uses analog rather than digital signals as an input to the comparator 74. A diode D1 is connected at one end to the output of the amplifier 68 and at another end to a capacitor C1 connected to ground. A resistor R1 is connected at one end between the diode D1 and capacitor C1. Another end of resistor R1 is connected to a resistor R2 in parallel with the reference input 78 of comparator 74. If R1 and R2 are equal, the output voltage $V_3$ on the reference input 78 will be one-half of the peak voltage output from amplifier 68, if the voltage drop across the diode is negligible. In the comparator 74, the varying sensor signal is compared to the output voltage $V_3$, and an output signal is provided to an interrupt device whenever the varying sensor signal falls above or below the $V_3$ reference. Thereafter, a pulse 76 is produced by the interrupt device and the length of the pulse 76 is determined by the processor 12 counting the number of timer pulses occurring during the pulse, as described in relation to FIGS. 4 and 5. In the circuit of FIG. 13, as in the circuit of FIG. 11, the signal $V_3$ is proportional to $V_1$ and the width of pulses derived from the comparator output are independent of the degradation of the light source 62 and sensor 66.

Figure 14:
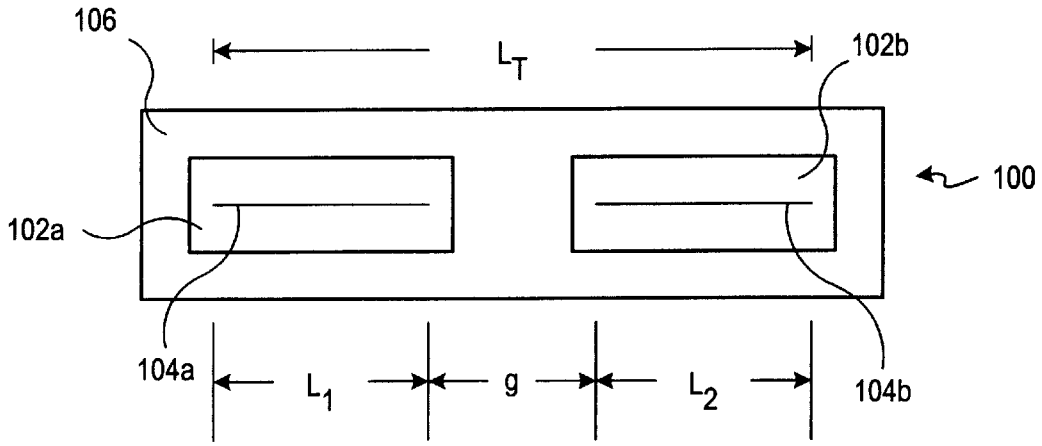
FIG. 14 is a simplified top view of a size and position sensing system which may be used in the document handling system of FIG. 8.
Figure 15:
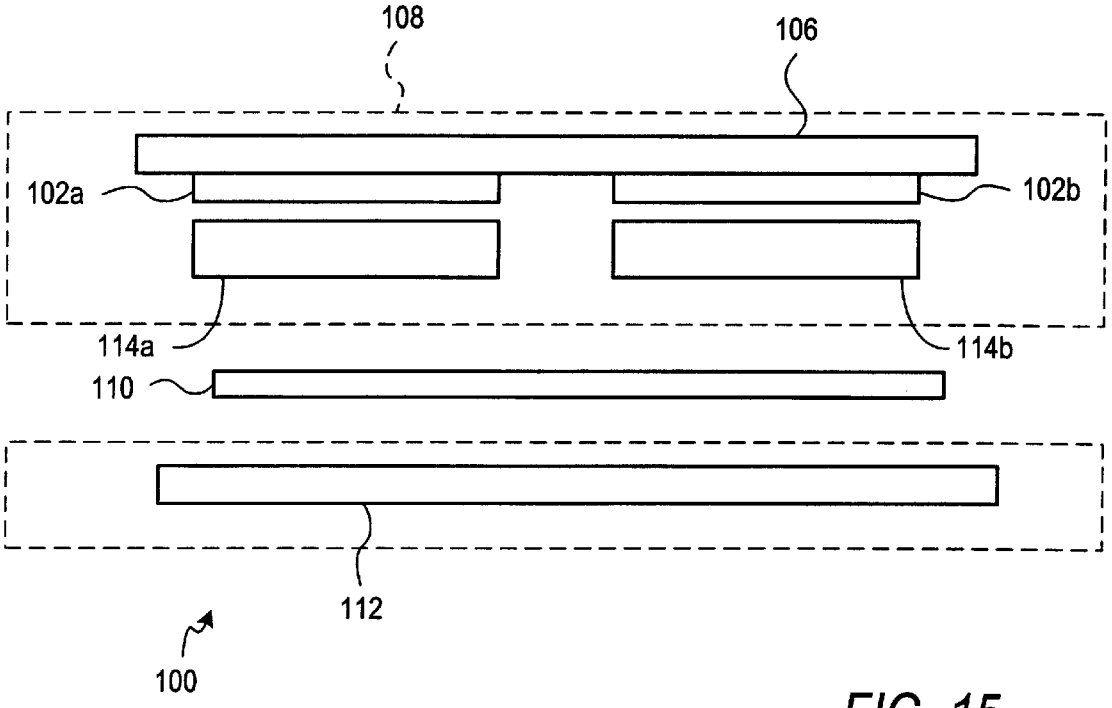
FIG. 15 is a simplified side view illustrating the operation of the size and position sensing system of FIG. 14.

FIGS. 14 and 15 illustrate another form of optical sensing system, designated generally by reference numeral 100, which may be used to detect the size and/or position of a currency bill under test. The system 100 may be used alternatively or in addition to any of the other sensing systems heretofore described. The system 100, like the systems of FIGS. 11 through 13, is particularly useful in foreign markets in which the size of individual bills varies with their denomination. The system 100 is also useful in applications which require precise bill position information such as, for example, where an attribute of the bills (e.g., color, density, thread location etc.) varies according to the position of the bill relative to the sensors.

The system 100 includes two photo-sensitive linear arrays 102*a*, 102*b* mounted on a printed circuit board 106. The linear arrays 102*a*, 102*b* each consists of multiple photo-sensing elements (or "pixels") aligned end-to-end along respective lines 104*a*, 104*b*. The arrays 102*a*, 102*b*, having respective lengths $L_1$ and $L_2$, are positioned on the circuit board 106 such that they are co-linear and separated by a gap "g." In one embodiment, the linear arrays 102*a*, 102*b* each comprise 512-element Texas Instruments model TSL 218 arrays, commercially available from Texas Instruments, Inc., Dallas, Tex. In the TSL 218 arrays, each pixel represents an area of about 5 mils in length, thus the arrays 102*a*, 102*b* have respective lengths $L_1$ and $L_2$ of 2.5 inches. In one embodiment, the gap g between the arrays is about 2 inches. In this embodiment, therefore, the distance between the left ends of array 102*a* and the right end of array 102*b* is seven inches ($L_1$+$L_2$+g), thus providing the system 100 with the ability to accommodate bills of up to seven inches in length. It will be appreciated that the system 100 may be designed with a single array and/or may use array(s) having fewer or greater numbers of elements, having a variety of alternative lengths $L_1$ and $L_2$ and/or having a variety of gap sizes (including, for instance, a gap size of zero).

The operation of system 100 is best illustrated in FIG. 15. The arrays 102*a*, 102*b* comprise a portion of an upper head assembly 108 of the currency evaluation machine, positioned above the transport path of a currency bill 110. A light source 112, which in one embodiment comprises a flourescent light tube, is positioned below and substantially parallel to the upper head assembly 108 and transport path. It will be appreciated that the illustrated embodiment may be applied to systems having non-horizontal (e.g., vertical) transport paths by positioning the arrays 102*a*, 102*b* and light source 112 on opposite sides (e.g., left and right) of the transport path.

The individual pixels in the arrays 102*a*, 102*b* are adapted to detect the presence or absence of light transmitted from the light tube 112. In one embodiment, gradient index lens arrays 114*a*, 114*b* are mounted between the light tube 112 and the respective sensor arrays 102*a*, 102*b*. The gradient index lens arrays 114*a*, 114*b* maximize the accuracy of the system 100 by focusing light from the light tube 112 onto the photo-sensing elements and filtering out extraneous light, reflections, etc. which may otherwise adversely affect the accuracy of the system 100. Alternatively, less accurate but relatively reliable measurements may be obtained by replacing the gradient index lens arrays 114*a*, 114*b* with simpler, less expensive filters such as, for example, a plate (not shown) with aligned holes or a continuous slot allowing passage of light from the light tube 112 to the arrays 102*a*, 102*b*.

When no bill is present between the light tube 112 and the arrays 102*a*, 102*b*, all of the photo-sensing elements are directly exposed to light. When a currency bill 110 is advanced along the transport path between the light tube 112 and the arrays 102*a*, 102*b*, a certain number of the photo-sensing elements will be blocked from light. The number of pixels blocked from light will determine the size of the bill 110. The bill 110 may be advanced across the optical path along its longer dimension, as illustrated in FIG. 15, or its narrow dimension. Moreover, the bill 110 may be advanced across the optical path in either a forward direction (e.g., "into the page" relative to FIG. 15) or a reverse direction (e.g., "out of the page" relative to FIG. 15). In the illustrated embodiment, the currency size is computed according to the following formula:

Size=[(# of pixels blocked in array 102*b*)+(# of pixels blocked in array 102*a*)]×[pixel size]+[gap size].

Thus, with a gap size of 2 inches and an individual pixel size of about 5 mils, the formula is as follows:

Size=[(# of pixels blocked in array 102*b*)+(# of pixels blocked in array 102*a*)]×[5 mils]+[2 inches].

The number of pixels blocked from light in the respective arrays 102*a*, 102*b* may also be used to determine the longitudinal position of the bill relative to the sensor arrays 102*a*, 102*b*. Position is measured by how far the bill is from center. A perfectly centered bill (e.g., positioned directly underneath the arrays such that equal numbers of pixels are blocked in each respective array 102*a*, 102*b*) is assigned a position of 0. Bills shifted to the left (toward array 102*a*) are assigned negative is positions and bills shifted to the right (toward array 102*a*) are assigned positive positions. Thus, for example, a bill shifted to the left by 0.5 inches is assigned a position of −0.5 inches, whereas a bill shifted to the right by 0.5 inches is assigned a position of +0.5 inches. The accuracy of the position measurement is limited by the pixel size. Thus, for example, where the pixel size is 5 mils, the position can be determined to within plus-or-minus 5 mils. More particularly, with a pixel size of 5 mils, the currency position is computed according to the following formula:

Position [[(# of pixels blocked in array 102*b*)−(# of pixels blocked in array 102*a*)]×[5 mils]]/2.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A currency handling system for evaluating currency with respect to master information, said currency handling system being operable to generate said master information, said currency handling system comprising:

at least one input device adapted to obtain from at least one authentic currency information associated with one or more attributes of said currency;

a processor for generating master information based on the information obtained by said input device from said authentic currency;

means for permitting a user to manually identify the type and denomination of said authentic currency from which said master information is obtained;

a memory for storing said master information as the master information for currency of the identified type and denomination; and means for comparing said stored master information with test data obtained by said input device from test currency to determine whether said test currency is currency of the identified type and denomination.

2. The currency handling system of claim 1 wherein said master information includes a plurality of numerical threshold values to be used in evaluating said test currency.

3. The currency handling system of claim 1 which is operable in a learn mode and a standard mode, and wherein said processor is adapted to derive a plurality of numerical thresholds from said master information.

4. The currency handling system of claim 3 wherein said numerical thresholds include upper and lower threshold numbers defining respective upper and lower limits of acceptability of currency to be evaluated.

5. The currency handling system of claim 1 and further including a communications port for transfer of signals to and from said system.

6. The currency handling system of claim 5 and wherein said means for permitting a user to manually identify the type and denomination of said authentic currency includes an operator interface panel for generating control signals including one or more signals for establishing said type and denomination of said authentic currency from which said master information is obtained.

7. The currency handling system of claim 6 wherein said control signals include an attribute-selection signal for selecting the attributes of said currency for which said master information will be obtained.

8. The currency handling system of claim 1 wherein at least one of the items of said master information corresponds to one of a length and a width dimension of said authentic currency.

9. The currency handling system of claim 1 wherein said input device comprises one or more sensors adapted to scan a reference currency to obtain one or more reference data values each corresponding to respective attributes of said reference currency, said processor being adapted to divide said master information and said test data by said reference data values to define normalized master information associated with said one or more attributes and normalized test data.

10. The currency handling system of claim 1 wherein said memory comprises a resident flash memory, and further including a socket adapted to removably receive a flash card therein, said socket being electrically coupled to said resident flash memory.

11. The currency handling system of claim 10 wherein at least some of said master information is exchanged between said resident flash memory and a flash card received in said socket.

12. The currency handling system of claim 1 wherein the currency includes currency from each of at least two different countries.

13. The currency handling system of claim 1 wherein said input device comprises one or more sensors.

14. The currency handling system of claim 1 wherein said system comprises a note counter having a processor adapted to count currency.

15. The currency handling system of claim 1 wherein said system comprises a currency authenticating machine having a processor adapted to compare said test data obtained from currency with at least some of said master information obtained from currency, and, based at least in part on said comparison, to authenticate currency.

16. The currency handling system of claim 1 wherein said system comprises a currency discriminating machine having a processor adapted to compare said test data obtained from currency with at least some of said master information obtained from currency, and, based at least in part on said comparison, to discriminate different denominations of currency.

17. The currency handling system of claim 1 wherein at least one item of said master information corresponds to at least one of a length dimension and a width dimension of said authentic currency.

18. The currency handling system of claim 1 wherein at least one item of said master information corresponds to an attribute other than physical dimensions of said authentic currency.

19. The currency handling system of claim 1 further comprising a communications port for receiving a plurality of control signals from an end user.

20. The currency handling system of claim 19 wherein said plurality of control signals includes one or more override signals for establishing alternate master information.

21. The currency handling system of claim 19 wherein said plurality of control signals includes an attribute-selection signal for selecting the attributes of said bills for which said master information will be obtained, said attribute-selection signal being separately definable for separate denominations of said bills.

22. The currency handling system of claim 19 wherein said plurality of control signals includes an authentication mode selection signal for selecting which items of said master information will be used in authentication of test bills, said authentication mode selection signal being separately definable for separate denominations of said bills.

23. The currency handling system of claim 1 having a single output receptacle.

24. The currency handling system of claim 1 wherein said comparing means is adapted to denominate currency of a plurality of different denominations independently of the dimensions of the currency.

25. The currency handling system of claim 1 wherein said comparing means is adapted to denominate currency of a plurality of different denominations, at least two of the denominations having the same dimensions.

26. A currency handling method comprising:

obtaining from at least one authentic currency information associated with one or more attributes of said currency;

generating master information based on the information obtained from said authentic currency, said master information including a plurality of numerical values each of which corresponds to a value of one of said attributes of said authentic currency;

manually identifying the type and denomination of said authentic currency from which said master information is obtained;

storing said master information in a memory as the master information for currency of the identified type and denomination;

obtaining from test currency information associated with the same attributes with which said master information is associated; and comparing said master information with the information obtained from said test currency to determine whether said test currency is authentic currency of the identified type and denomination.

27. The currency handling method of claim 26 wherein obtaining master information includes determining a plurality of numerical threshold values, each of said threshold values corresponding to a value of one of said attributes of said authentic currency.

28. The currency handling method of claim 26 wherein obtaining master information comprises scanning a set of authentic currency to obtain master information associated with one or more attributes of said authentic currency.

29. The currency handling method of claim 26 wherein storing includes storing said numerical thresholds in a memory.

30. The method of claim 29 wherein said numerical thresholds include upper and lower threshold numbers defining respective upper and lower limits of acceptability of currency to be evaluated.

31. The method of claim 28 and further comprising:

coupling a flash card to said memory; and transferring said master information between said memory and said flash card.

32. The method of claim 26 and further comprising operatively coupling a flash card containing said master information to said memory, and wherein obtaining master information comprises copying master information from said flash card to said memory.

33. The method of claim 28 wherein said test currency is delivered to a single output receptacle after evaluation.

34. The method of claim 28 wherein said comparing determines whether said test currency is authentic currency of the identified type and denomination independently of the dimensions of the currency.

35. The method of claim 28 wherein said comparing determines whether test currency of a plurality of different denominations is authentic currency of the identified type and denomination, at least two of the denominations having the same dimensions.

36. A currency handling system for evaluating currency with respect to independently derived master information, said currency handling system being operable in a learn mode and a standard mode, said currency handling system comprising:

at least one sensor, adapted in said learn mode to obtain from authentic currency, master information associated with one or more attributes of said authentic currency, said sensor being adapted in said standard mode to obtain from test currency, test data associated with one or more attributes of said test currency including data corresponding to a pattern of optical reflectance data from a surface of said currency;

a processor for generating master information based on the information obtained by said sensor from said authentic currency;

means for permitting a user to manually identify the type and denomination of said authentic currency from which said master information is obtained;

said processor being adapted in said standard mode to evaluate each test currency by comparing the test data associated with at least one of said attributes to the master information corresponding to said at least one of said attributes;

a memory for storing said master information; and an operator actuable selector for selecting said learn mode and said standard mode.

37. The currency handling system of claim 36 wherein said memory stores master information obtained from currency bills issued by different countries.

38. The currency handling system of claim 36, further comprising:

a size sensor adapted to obtain from a currency size information corresponding at least one physical dimension of the currency; and said processor using said size information to evaluate a test currency.

39. The currency handling system of claim 36 wherein at least one item of said master information corresponds to the length of said master currency bills, and wherein an initial determination of authenticity is made regarding said test bills based on a comparison of the length of said test bills to the items of master information corresponding to the length of said master bills.

40. The currency handling system of claim 36 wherein at least one item of said master information corresponds to the width of said master currency bills, and wherein an initial determination of authenticity is made regarding said test bills based on a comparison of the width of said test bills to the items of master information corresponding to the width of said master bills.

41. A currency handling machine operable in a learn mode and a standard mode, said currency handling machine comprising:

at least one learn mode sensor adapted in said learn mode to scan a master currency and to obtain master information associated with said master currency including information corresponding to a pattern of optical reflectance data from a surface of said currency;

a processor for generating master information based on the information obtained by said sensor from said master currency;

means for permitting a user to manually identify the type and denomination of said master currency from which said master information is obtained;

a memory for storing said master information;

one or more standard mode sensors adapted in said standard mode to scan a test currency to obtain test data associated with said test currency; and a processor adapted in said standard mode to compare said test data to said master information.

42. The currency handling machine of claim 41 wherein said memory stores master information obtained from currency bills issued by different countries.

43. The currency handling machine of claim 41 including one or more sensors operable in said learn mode as said learn mode sensors and operable in said standard mode as said standard mode sensors.

44. A currency handling machine operable in a learn mode and a standard mode, said currency handling machine comprising:

an input receptacle for receiving currency, said currency including in said learn mode at least one master currency, and said currency including in said standard mode at least one test currency;

an output receptacle for receiving in said learn mode the master currency and for receiving in said standard mode the test currency;

a transport mechanism for transporting in said learn mode the master currency and for transporting in said standard mode the test currency, from said input receptacle to said output receptacle along a transport path;

one or more sensors positioned along said transport path between said input receptacle and said output receptacle, said sensors including a learn mode sensor adapted in said learn mode to scan said master currency to obtain master information associated with said master currency and a standard mode sensor adapted in said standard mode to scan said test currency to obtain test data associated with said test currency, said master information and said test data including information and data corresponding to a pattern of optical reflectance data from a surface of said currency;

a processor for generating master information based on the information obtained by said sensor from said master currency;

means for permitting a user to manually identify the type and denomination of said master currency from which said master information is obtained;

a memory for storing said master information; and said processor being adapted in said standard mode to evaluate a test currency by comparing said test data to said master information.

45. The currency handling machine of claim 44 wherein each of said one or more sensors is operable in said learn mode as said learn mode sensor and operable in said standard mode as said standard mode sensor.

46. The currency handling machine of claim 44 wherein the currency includes currency bills issued by different countries.

47. The currency handling machine of claim 44 wherein said processor is adapted in said standard mode to determine the authenticity of said test currency by comparing said test data to said master information.

48. A currency authenticating machine operable in a learn mode and a standard mode, said currency authenticating machine comprising:

at least one learn mode sensor adapted in said learn mode to scan a master currency and to obtain master information associated with said master currency including data corresponding to a pattern of optical reflectance data from a surface of said currency;

a processor for generating master information based on the information obtained by said sensor from said master currency;

means for permitting a user to manually identify the type and denomination of said master currency from which said master information is obtained;

a memory for storing said master information;

one or more standard mode sensors adapted in said standard mode to scan a test currency to obtain test data associated with said test currency including data corresponding to a pattern of optical reflectance data from a surface of said currency; and a processor adapted in said standard mode to determine the authenticity of said test currency by comparing said test data to said master information.

49. The currency authenticating machine of claim 48 wherein the currency includes currency bills issued by different countries.

50. The currency authenticating machine of claim 48 wherein the currency includes different denominations of currency bills.

51. The currency authenticating machine of claim 50 further including a plurality of output receptacles, each for receiving in said standard mode one of said denominations of currency bills after they have been processed by the currency authenticating machine as test currency.

52. The currency authenticating machine of claim 48 further including a plurality of output receptacles, each for receiving in said standard mode said test currency after they have been processed by the currency authenticating machine.

53. The currency authenticating machine of claim 50 wherein a selected one or more of the output receptacles receive in said learn mode the master currency after they have been processed by the currency authenticating machine.

54. The currency authenticating machine of claim 50 further including an input receptacle for receiving currency to be processed by the currency authenticating machine in said learn mode and in said standard mode, the master currency returning to the input receptacle after they have been processed by the currency authenticating machine in said learn mode.

55. The currency authenticating machine of claim 48 further including one or more dual-function sensors operable in both said learn mode and said standard mode, said dual-function sensors being operable in said learn mode as one of said learn mode sensors and operable in said standard mode as one of said standard mode sensors.

56. A method of evaluating currency comprising the steps of:

obtaining from a plurality of master currency bills information associated with one or more attributes of said currency;

generating master information based on the information obtained from said master currency;

manually identifying the type and denomination of said master currency from which said master information is obtained;

storing said master information in a memory as the master information for currency of the identified country and denomination;

obtaining from test currency information associated with the same attributes with which said master information is associated;

scanning a reference object to obtain one or more reference data values;

dividing said master information and said test data by said reference data values to define respective normalized master information and normalized test data; and comparing said normalized master information with the normalized test data to evaluate whether said test currency is authentic currency of the identified type and denomination.

57. The currency evaluating method of claim 56 wherein the plurality of master currency bills comprises a plurality of denominations of master currency bills issued by at least two different countries.

58. The currency evaluating method of claim 56 wherein the plurality of master currency bills comprises a plurality of denominations of master currency bills issued by ones of a given family of issuing countries.

59. The currency evaluating method of claim 56 wherein said master information includes one or more numerical threshold values to be used in evaluating said test bills.

60. The currency evaluating method of claim 59 wherein said numerical thresholds include upper and lower threshold numbers defining respective upper and lower limits of acceptability of a test bill.

61. The currency evaluating method of claim 59 further including dividing said numerical threshold values by said reference data values to define normalized numerical threshold values; and wherein evaluating said test bills comprises comparing the normalized test data to the normalized numerical threshold values.

62. The currency evaluating method of claim 56 wherein said storing comprises storing said master information in a resident flash memory, the method further comprising:

electrically coupling a first flash card to said resident flash memory, said first flash card having a flash card memory therein, said master information being copied from said resident flash memory to said flash card memory;

uncoupling said first flash card from said resident flash memory;

electrically coupling said first flash card to a secondary currency evaluation machine; and copying said master information from said flash card memory to a resident flash memory of the secondary currency evaluating machine.

63. The currency evaluating method of claim 62 wherein said master information includes one or more numerical thresholds, and further comprising:

scanning a test bill in said secondary machine to obtain test data associated with said test bill;

scanning a reference object in said secondary machine to obtain one or more reference data values;

dividing said test data and said numerical thresholds by said reference data values in said secondary machine to define normalized test data and normalized numerical thresholds; and evaluating a test bill in said secondary machine by comparing the normalized test data to the normalized numerical thresholds.

64. The currency evaluating method of claim 61 wherein said storing comprises storing said normalized numerical threshold values in a resident flash memory, the method further comprising:

electrically coupling a flash card to said resident flash memory, said flash card having a flash card memory therein, and copying said normalized numerical thresholds from said resident flash memory to said flash card memory;

uncoupling said flash card from said resident flash memory; and electrically coupling said flash card to a secondary currency evaluating machine, and copying said normalized numerical thresholds from said flash card memory to flash memory of the secondary currency evaluating machine.

65. The currency evaluating method of claim 56 wherein said storing comprises storing said master information in a resident flash memory, the method further comprising electrically coupling a flash card to said resident memory, said flash card having a flash card memory therein containing master information, and wherein storing master information includes copying said master information from said flash card memory to said resident memory.

66. A currency evaluation device operable in a learn mode to process currency and acquire master information from said currency, said currency evaluation device comprising:

an input receptacle for receiving currency to be processed in said learn mode;

an output receptacle for receiving the currency after said currency has been processed in said learn mode;

a transport mechanism for transporting the currency in said learn mode from said input receptacle to said output receptacle along a transport path;

one or more sensors positioned along said transport path between said input receptacle and said output receptacle, the sensors being adapted in said learn mode to scan the currency processed in said learn mode to obtain master information associated with one or more attributes of said currency, said attributes including a pattern of optical reflectance data;

a processor for generating master information based on the information obtained by said sensors from master currency;

means for permitting a user to manually identify the type and denomination of said master currency from which said master information is obtained;

a memory for storing in said learn mode the master information obtained from said master currency as the master information for currency of the identified type and denomination; and means for comparing said stored master information with test data obtained by said sensors from test currency to determine whether said test currency is currency of the identified type and denomination.

67. The device of claim 66 wherein the memory is preloaded with first master information associated with a first currency type, the currency processed in said learn mode comprising currency of a second currency type, the memory storing after said operation of said learn mode master information associated with currency of said first and second currency types.

68. The device of claim 67 wherein said first and second currency types comprise currencies issued by two different countries.

69. A method of authenticating currency using a currency authenticating device, the method comprising the steps of:

scanning a plurality of types of master currency bills to obtain master authentication information associated with said master currency bills;

generating master authentication information based on the information obtained from said master currency bills;

manually identifying the type and denomination of said master currency bills from which said master authentication information is obtained;

storing said master authentication information in a resident memory of the currency authenticating device as the master authentication information for currency of the identified type and denomination;

scanning test bills to obtain test authentication data associated with said test bills; and determining the authenticity of said test bills by comparing the test authentication data to the master authentication information to determine whether said test currency is authentic currency of the identified type and denomination.

70. The currency authenticating method of claim 69 wherein the plurality of master currency bills comprises a plurality of denominations of master currency bills.

71. The currency authenticating method of claim 69 wherein the plurality of master currency bills comprises a plurality of denominations of master currency bills from each of a plurality of countries.

72. The currency authenticating method of claim 69 wherein said master information includes one or more numerical threshold values to be used in determining the authenticity of said test bills.

73. The currency authenticating method of claim 72 wherein numerical thresholds include upper and lower threshold number defining respective upper and lower limits of acceptability of said test bill, a determination of authenticity being made regarding said test bill when the test data obtained from said test bill is between the upper and lower threshold numbers.

74. The currency authenticating method of claim 72 further comprising:

dividing said numerical thresholds and said test data by said reference data values to define respective normalized numerical thresholds and normalized test data; and determining the authenticity of said test bill by comparing the normalized test data to the normalized numerical thresholds.

75. The currency authenticating method of claim 69 wherein the resident memory comprises a flash memory, the method further comprising:

electrically coupling a first flash card to said resident flash memory, said first flash card having a flash card memory therein, and copying said master authentication information from said resident flash memory to said flash card memory;

uncoupling said first flash card from said resident flash memory; and electrically coupling said first flash card to a secondary currency authenticating machine, and copying said master authentication information from said flash card memory to resident flash memories of the secondary currency authenticating machine.

76. The currency authenticating method of claim 75 further comprising:

scanning a test bill in said secondary machine to obtain test data associated with said test bill; and determining the authenticity of said test bill in said secondary machine by comparing the test data to the master authentication information.

77. The currency authenticating method claim 74 wherein the resident memory comprises a flash memory, the method further comprising:

electrically coupling a flash card to said resident flash memory, said flash card having a flash card memory therein, and copying said normalized numerical thresholds from said resident flash memory to said flash card memory;

uncoupling said flash card from said resident flash memory; and electrically coupling said flash card to a secondary currency authenticating machine, and copying said normalized numerical thresholds from said flash card memory to flash memories of the secondary currency authenticating machine.

78. The currency authenticating method of claim 69 wherein the resident memory comprises a flash memory, the method further comprising:

electrically coupling a flash card to said resident flash memory, said flash card having a flash card memory therein, the flash card memory of said flash card having master authentication information; and copying said master authentication information to said resident flash memory from said flash card memory.

79. A size-detecting note counter for counting a stack of test currency bills having the same denomination, said note counter comprising:

a transport mechanism for advancing currency bills, one at a time, along a transport path;

a sensor optically coupled with a light source along an optical path, wherein the optical path and the transport path intersect such that bills being transported along the transport path will intersect the optical path, the sensor generating an optical signal in response to the amount of light detected, the sensor receiving less light when a bill is intersecting the optical path than when no bill is intersecting the optical path, wherein the amount of light received by the sensor is inversely proportional to the degree to which the bill intersects the optical path, the value of the optical signal being inversely proportional to the degree to which a bill intersects the optical path;

a comparator coupled to the sensor and receiving the optical signal, the comparator also receiving a reference signal, wherein the comparator compares the optical signal with the reference signal and initiates the production of a pulse in response to the optical signal falling below the reference signal and terminates the pulse in response to the optical signal rising above the reference signal;

a memory storing size information for currency bills of different denominations; and a processor for determining the duration of a pulse associated with a bill being transported through the optical path, the duration of the pulse being proportional to the size of the bill, the processor being adapted to make an initial determination of the denomination of the bill by comparing the size of the bill to the stored size information associated with different denominations of currency bills.

80. The size-detecting note counter of claim 79 wherein the processor is adapted to determine the size and denomination of a first set of one or more bills transported through the optical path, and provided the bill or bills of the first set are determined to have the same denomination, the processor being adapted to subsequently determine the authenticity of a second set of one or more bills transported through the optical path by comparing the determined size of each bill of the second set to stored size information corresponding to the determined denomination of the bills of the first set.

81. A size-detecting currency handling device comprising:

a transport mechanism adapted to advance currency bills, one at a time, along a transport path;

a light source;

a sensor adjacent the transport path detecting light from the light source and positioned such that bills being transported along the transport path successively interfere with the reception of light by the sensor from the light source, wherein the length of time a bill interferes with the reception of light by the sensor is indicative of the size of the bill, the sensor generating an optical signal having an intensity responsive to the amount of light detected, the optical signal having a first intensity when no bill is interfering with the reception of light, the intensity of the optical signal varying in response to the degree to which a bill interferes with the reception of light by the sensor;

a comparator coupled to the sensor and receiving the optical signal, the comparator also receiving a reference signal having an intensity proportional to the first intensity, wherein the comparator compares the optical signal with the reference signal and initiates the production of a pulse in response to the optical signal falling below the reference signal and terminates the pulse in response to the optical signal rising above the reference signal;

a memory storing size information for currency bills of different denominations; and a processor for determining the duration of a pulse associated with a bill being transported along the transport path and interfering with the reception of light by the sensor, the duration of the pulse being proportional to the size of the bill, the processor being adapted to make a determination of the denomination of the bill by comparing the size of the bill to the stored size information associated with different denominations of currency bills.

82. The device of claim 81 wherein the reference signal has an intensity of one-half the first intensity.

83. A size-detecting currency handling device being operable in a learn mode and a standard mode, the device comprising:

a transport mechanism adapted to advance currency bills, one at a time, along a transport path;

a light source;

a sensor adjacent the transport path detecting light from the light source and positioned such that bills being transported along the transport path successively interfere with the reception of light by the sensor from the light source, wherein the length of time a bill interferes with the reception of light by the sensor is indicative of the size of the bill, the sensor generating an optical signal having an intensity responsive to the amount of light detected, the optical signal having a first intensity when no bill is interfering with the reception of light, the intensity of the optical signal varying in response to the degree to which a bill interferes with the reception of light by the sensor;

a comparator coupled to the sensor and receiving the optical signal, the comparator also receiving a reference signal having an intensity proportional to the first intensity, wherein the comparator compares the optical signal with the reference signal and initiates the production of a pulse in response to the optical signal falling below the reference signal and terminates the pulse in response to the optical signal rising above the reference signal;

a memory storing size information for currency bills of different denominations; and a processor for determining the duration of a pulse associated with a bill being transported along the transport path and interfering with the reception of light by the sensor, the duration of the pulse being proportional to the size of the bill;

the processor being adapted in the standard mode to make a determination of the denomination of the bill by comparing the size of the bill to the stored size information associated with different denominations of currency bills; and the processor being adapted in the learn mode to store information indicative of the size of the bill as master size information in the memory.

84. A currency authenticating device comprising:

at least one input device adapted to obtain from at least one authentic currency information associated with one or more attributes of said currency;

a processor for generating master information based on the information obtained by said input device from said authentic currency;

means for permitting a user to manually identify the type and denomination of said authentic currency from which said master information is obtained;

a memory for storing said master information as the master information for currency of the identified type and denomination;

a sensor adapted to scan a test bill to obtain test data associated with the test bill and adapted to scan a reference object to obtain reference data associated with the reference object; and said processor being adapted to receive the test, master, and reference data and adapted to divide the test data by the reference data to define normalized test data and to divide the master data by the reference data to define normalized master data, the processor being adapted to determine the authenticity of the test bill by comparing the normalized test data to the normalized master data.

85. The currency authenticating device of claim 84 further comprising:

a flash card having a flash card memory; and a socket adapted to removably receive the flash card therein, the socket being electrically coupled to the device memory of the currency authenticating device, wherein the device memory is a flash memory and wherein the processor is adapted to copy normalized master data from the device flash memory to the flash card memory, the flash card thereafter being adapted to be removed from the socket.

86. The currency authenticating device of claim 84 further comprising:

a flash card having a flash card memory; and a socket adapted to removably receive the flash card therein, the socket being electrically coupled to the device memory of the currency authenticating device, wherein the device memory is a flash memory and wherein the normalized master data is copied from the device flash memory to the flash card memory, the flash card thereafter being adapted to be removed from the socket and electrically coupled to one or more secondary currency authenticating devices, each one or more secondary device having a device memory therein, the normalized master data being copied from the flash card memory to the one or more device flash memories of the one or more secondary currency authenticating devices.

87. In combination, the currency authenticating device of claim 85 and a plurality of secondary currency authenticating devices, each of the secondary currency authenticating devices being operable in the standard mode and comprising:

a resident flash memory adapted to store the normalized numerical thresholds received from the flash card;

one or more sensors adapted to scan test bills to obtain test data associated with one or more attributes of the test bills, the sensors further being adapted to scan a reference object to obtain reference data values associated with one or more attributes of the reference object; and a processor for dividing individual items of the test data by the reference data values to define normalized test data associated with the one or more attributes, the processor being adapted to determine the authenticity of the test bills by comparing the normalized test data associated with a selected one or more of the attributes to the normalized numerical thresholds associated with the selected one or more of the attributes.

88. A method of authenticating currency using a currency authenticating device having a device memory, the device memory having master data stored therein associated with a genuine currency bill, the method comprising:

scanning a test bill to obtain test data associated with the test bill;

scanning a reference object to obtain reference data associated with the reference object;

dividing the test data by the reference data to obtain normalized test data;

dividing the master data by the reference data to obtain normalized master data; and determining the authenticity of the test bill by comparing the normalized test data to the normalized master data.

89. A method of authenticating currency using a currency authenticating device having a device memory, the device memory having master data stored therein associated with a genuine currency bill, the method comprising:

retrieving test data from a test bill;

retrieving reference data from a reference object;

dividing the test data by the reference data to obtain normalized test data;

dividing the master data by the reference data to obtain normalized master data; and determining the authenticity of the test bill by comparing the normalized test data to the normalized master data.

90. The currency authenticating method of claim 89 further comprising:

electrically coupling a flash card to the device memory, the flash card having a flash card memory therein, and copying the normalized master data from the device memory to the flash card memory;

uncoupling the flash card from the device memory; and electrically coupling the flash card to a plurality of secondary currency authenticating devices, and copying the normalized master data from the flash card memory to respective device memories of the secondary currency authenticating devices.

91. The currency authenticating method of claim 90 further comprising:

scanning test bills in each of the secondary devices to obtain test data associated with one or more attributes of the test bills;

scanning a reference object in each of the secondary devices to obtain reference data values associated with one or more attributes of the reference object; and dividing the test data by the reference data values in each of the secondary devices to define normalized test data associated with the one or more attributes; and determining the authenticity of the test bills in each of the secondary devices by comparing the normalized test data associated with a selected one or more of the attributes to the normalized or more master data associated with the selected one or more of the attributes.

92. A currency denominating machine operable in a learn mode and a standard mode for evaluating each of at least two different types of currency, said currency denominating machine comprising:

one or more learn mode sensors adapted in said learn mode to scan a master currency bill to obtain master information associated with said master currency bill including information corresponding to a pattern of optical reflectance data from a surface of a document;

one or more standard mode sensors adapted in said standard mode to scan a test bill to obtain test data associated with said test bill including test data corresponding to a pattern of optical reflectance data from a surface of a document;

a processor for generating master information based on the information obtained by said learn mode sensors from said master currency bill;

means for permitting a user to manually identify the type and denomination of said master currency bill from which said master information is obtained;

a memory for storing said master information as the master information for currency of the identified type and denomination; and said processor being adapted in said standard mode to determine the identified type and denomination of said test bill by comparing the test data to the master information.

93. The currency denominating machine of claim 92, and further including a communications port for receiving a plurality of control signals from outside of said machine, said control signals including override signals for establishing alternate master information for use by said processor.

94. The currency denominating machine of claim 92 including one or more dual-function sensors operable in both said learn mode and said standard mode, said dual-function sensors being operable in said learn mode as one of said learn mode sensors and operable in said standard mode as one of said standard mode sensors.

95. The currency denominating machine of claim 92 wherein the learn mode sensors are adapted to scan a plurality of master currency bills to obtain master information associated with the master currency bills, the standard mode sensors are adapted to scan a plurality of test bills to obtain test data associated with said test bills, and the processor is adapted to determine the type and denomination of each of said test bills by comparing the test data to the master information.

96. The currency denominating machine of claim 92 wherein the memory is a resident flash memory.

97. The currency denominating machine of claim 92 wherein said processor is adapted in said learn mode to receive the master information from the learn mode sensor and to store master denomination information in the memory associated with the type and denomination of the master currency; and wherein the processor is adapted in said standard mode to receive the test data, generate test type and denomination information associated with the test bill, compare the test type and denomination information to the master type and denomination information, and determine the type and denomination of said test bill when the test type and denomination satisfactorily compares with the master type and denomination information.

98. The currency denominating machine of claim 96 and further including a socket adapted to removably receive a flash card therein, said socket being electrically coupled to said resident flash memory, wherein said processor is adapted to exchange said master information between said resident flash memory and a flash card when said flash card is inserted into said socket.

99. A currency authenticating machine operable in a learn mode and a standard mode, said currency authentication machine comprising:

one or more sensors adapted in said learn mode to scan master currency bills to obtain master information associated with one or more attributes of said master currency bills;

one or more sensors adapted in said standard mode to scan test bills to obtain test data associated with one or more attributes of said test bills;

a processor for generating master information based on the information obtained by said sensors from said master currency bills;

means for permitting a user to manually identify the type and denomination of said master currency bills from which said master information is obtained;

said processor being adapted in said standard mode to determine the authenticity of each of said test bills by comparing the test data associated with a selected one or more of said attributes to the master information corresponding to the selected one or more of said attributes;

a resident flash memory for storing said master information as the master information for currency of the identified type and denomination; and a communications port for receiving a plurality of control signals from outside of said machine.

100. The currency authenticating machine of claim 99 wherein said master information includes a plurality of numerical threshold values to be used in determining the authenticity of said test bills, each of said threshold values corresponding to a value of one of the said attributes in a particular denomination of currency.

101. The currency authenticating machine of claim 100 wherein said processor is adapted in said learn mode to derive said plurality of numerical thresholds.

102. The currency authenticating machine of claim 100 wherein said numerical thresholds include upper and lower threshold numbers defining respective upper and lower limit of acceptability of said test bills, a positive determination of authenticity being made regarding individual ones of said test bills when a numerical value of test data associated with the selected attribute in said individual test bill is between the upper and lower threshold numbers associated with said selected attribute.

103. The currency authenticating machine of claim 99 wherein said plurality of control signals includes one or more override signals for permitting alternate master information to said resident memory for use by said currency authenticating machine, said processor being adapted to determine authenticity of said test bills being made by comparing the test data associated with said selected one of said attributes to the alternate master information associated with said selected attribute.

104. The currency authenticating machine of claim 99 wherein said plurality of control signals includes an attribute-selection signal for selecting the attributes of said bills for which said master information will be obtained, said attribute-selectionsignal being separately definable for separate denominations of said bills.

105. The currency authenticating machine of claim 100 wherein said plurality of control signals includes an authentication mode selection signal for selecting which of said threshold values will be used in authentication of said test bills, said authentication mode selection signal being separately definable for separate denominations of said bills.

106. The currency authenticating machine of claim 99 wherein at least one item of said master information corresponds to the length of said master currency bills, wherein an initial determination of authenticity is made regarding said test bills based on a comparison of the length of said test bills to the items of master information corresponding to the length of said master bills.

107. The currency authenticating machine of claim 99 wherein at least one item of said master information corresponds to the width of said master currency bills, wherein an initial determination of authenticity is made regarding said test bills based on a comparison of the width of said test bills to the items of master information corresponding to the width of said master bills.

108. The currency authenticating machine of claim 99 further comprising:

a flash card having a flash card memory; and a socket adapted to removably receive said flash card therein, said socket being electrically coupled to said resident flash memory of said currency authenticating machine, wherein said master information is copied from said resident flash memory to said flash card memory when said flash card is inserted into said socket, said flash card thereafter being adapted to be removed from said socket and electrically coupled to a plurality of secondary currency authenticating machines, said master information being copied from said flash card memory to the resident flash memories of each of the secondary currency authenticating machines when the flash card is electrically coupled to each of the plurality of secondary currency authenticating machines.

109. In combination, the currency authenticating machine of claim 108 and a plurality of secondary currency authenticating machines, each of said secondary currency authenticating machines being operable in said standard mode and comprising:

a resident flash memory for storing said master information received from said flash card;

one or more sensors for scanning test bills to obtain test data associated with one or more attributes of said test bills; and a processor adapted to determine the authenticity of said test bills by comparing the test data associated with a selected one or more of said attributes to the master information associated with the selected one or more of said attributes.

110. A currency authenticating method comprising:

scanning master currency bills to obtain master information associated with one or more attributes of said master currency bills;

obtaining from at least one authentic currency information associated with one or more attributes of said currency;

generating master information based on the information obtained from said authentic currency;

manually identifying the type and denomination of said authentic currency from which said master information is obtained;

storing said master information in a memory as the master information for currency of the identified type and denomination;

obtaining from test currency information associated with the same attributes with which said master information is associated; and comparing said master information with the information obtained from said test currency to determine whether said test currency is authentic currency of the identified type and denomination;

wherein at least one item of said master information corresponds to one of the length and width of said master currency bills, an initial determination of authenticity being made regarding said test bills based on a comparison of one of the length and width of said test bills to the items of master information corresponding to one of the length and width of said master bills; and wherein master information corresponding to an attribute other than said one of the length or width is also used to validate the initial determination of authenticity of said bills.

111. The currency authenticating method of claim 110 wherein said master information includes a plurality of numerical threshold values to be used in determining the authenticity of said test bills, each of said threshold values corresponding to a value of one of said attributes in a particular denomination of currency.

112. A currency authenticating method comprising:

obtaining from at least one authentic currency information associated with one or more attributes of said currency;

generating master information based on the information obtained from said authentic currency;

manually identifying the type and denomination of said authentic currency from which said master information is obtained;

storing said master information in a memory as the master information for currency of the identified type and denomination;

obtaining from test currency information associated with the same attributes with which said master information is associated;

deriving a plurality of numerical thresholds from said master information, each of said numerical thresholds corresponding to a value of one of said attributes in a particular denomination of currency and comprising a part of said master information;

storing said numerical thresholds in a resident flash memory; and determining the authenticity of each of said test bills by comparing the test data associated with a selected one or more of said attributes to the numerical thresholds corresponding to the selected one or more of said attributes.

113. The currency authenticating method of claim 112 wherein said numerical thresholds include upper and lower threshold numbers defining respective upper and lower limits of acceptability of said test bills, a determination of authenticity being made regarding each of said test bills when the test data associated with the selected attribute of said test bill is between the upper and lower threshold numbers associated with said selected attribute.

114. The currency handling system of claim 112 wherein said memory comprises a resident flash memory, and further including a socket adapted to removably receive a flash card therein, said socket being electrically coupled to said resident flash memory.

115. The currency handling system of claim 114 wherein at least some of said master information is transferred between said resident flash memory and to said flash card.

* * * * *